US011794947B2

(12) United States Patent
Hoefte et al.

(10) Patent No.: US 11,794,947 B2
(45) Date of Patent: Oct. 24, 2023

(54) CARDBOARD SUPPORT ELEMENT

(71) Applicant: The Procter & Gamble Company, Cincinnati, OH (US)

(72) Inventors: Paulus Antonius Augustinus Hoefte, Aslene (BE); Clara Sophie Lea Ng Pak Leung, Ixelles (BE); Joost Peter Leflere, Mechelen (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 17/365,480

(22) Filed: Jul. 1, 2021

(65) Prior Publication Data

US 2022/0009671 A1 Jan. 13, 2022

(30) Foreign Application Priority Data

Jul. 9, 2020 (EP) ..... 20185107

(51) Int. Cl.
*B65D 5/68* (2006.01)
*B65D 5/44* (2006.01)

(52) U.S. Cl.
CPC ..... *B65D 5/445* (2013.01); *B65D 5/685* (2013.01)

(58) Field of Classification Search
CPC .... B65D 5/441; B65D 5/445; B65D 5/48028; B65D 5/68–685
USPC ..... 229/919, 122.32, 122.34
See application file for complete search history.

(56) References Cited

U.S. PATENT DOCUMENTS 1,130,271 A * 3/1915 Hammond ..... B65D 5/685 206/815
1,664,308 A * 3/1928 Miller ..... B65D 5/4295 119/490
2,032,799 A * 3/1936 Hagopian ..... B65D 85/34 217/3 BC
2,251,283 A 8/1941 Johnson
2,474,523 A 6/1949 Reynolds
2,745,589 A 5/1956 Daly
2,777,630 A 1/1957 Moberger
2,836,343 A 5/1958 Theodore
3,116,007 A 12/1963 Esposito et al.
3,159,326 A * 12/1964 Stonebanks ..... B65D 5/441 220/639
3,366,496 A 1/1968 Bomar et al.
RE26,557 E 3/1969 Houston
3,512,699 A 5/1970 Wilson
(Continued)

FOREIGN PATENT DOCUMENTS

AT 334276 B 1/1976
CH 710519 A2 6/2016
(Continued)

OTHER PUBLICATIONS

PCT Search Report and Written Opinion for PCT/US2021/040979 dated Sep. 24, 2021.
(Continued)

*Primary Examiner* — Nathan J Newhouse
*Assistant Examiner* — Phillip D Schmidt
(74) *Attorney, Agent, or Firm* — Gary J. Foose

(57) ABSTRACT

A support element for a cardboard container. A lid incorporating the support element. A consumer product incorporating the support element, the lid, and the container. A cardboard blank for forming the support element. Related methods.

6 Claims, 8 Drawing Sheets

(56) References Cited

U.S. PATENT DOCUMENTS

| | | | | |
|---|---|---|---|---|
| 4,053,100 | A | 10/1977 | Baptist | |
| 4,083,455 | A | 4/1978 | Keating, Jr. | |
| 4,304,355 | A | 12/1981 | Sykora | |
| 4,441,648 | A | 4/1984 | Portsmouth | |
| 4,834,255 | A | 5/1989 | Boots | |
| 4,948,033 | A * | 8/1990 | Halsell, II | B65D 5/445 229/117.16 |
| 5,040,722 | A | 8/1991 | Fromion | |
| 5,103,972 | A | 4/1992 | Ackeret | |
| 5,161,734 | A | 11/1992 | Ruehl et al. | |
| 5,299,732 | A | 4/1994 | Armor et al. | |
| 5,439,133 | A | 8/1995 | Stone | |
| 5,450,998 | A * | 9/1995 | Esse | B65D 5/32 229/122.34 |
| 5,505,374 | A | 4/1996 | Stone | |
| 5,515,996 | A | 5/1996 | Stone | |
| 5,518,172 | A | 5/1996 | Nanno | |
| 5,551,938 | A | 9/1996 | Stone | |
| 5,627,150 | A | 5/1997 | Peterson et al. | |
| 5,725,144 | A | 3/1998 | Stone et al. | |
| 6,604,676 | B2 | 8/2003 | Giblin | |
| 6,672,474 | B2 | 1/2004 | May et al. | |
| D499,022 | S | 11/2004 | Sun | |
| 7,377,385 | B2 | 5/2008 | Giannini et al. | |
| 7,473,215 | B2 * | 1/2009 | Moen | B65D 5/323 493/128 |
| 7,726,552 | B2 | 6/2010 | Chadima | |
| 8,443,978 | B2 | 5/2013 | Royer | |
| 8,746,444 | B2 | 6/2014 | Dehlin | |
| 8,997,979 | B2 | 4/2015 | Ghini | |
| 9,475,605 | B2 | 10/2016 | Everett | |
| 9,783,335 | B2 | 10/2017 | Everett | |
| 9,881,788 | B2 | 1/2018 | Kim et al. | |
| 10,017,291 | B2 | 7/2018 | Smith | |
| 10,232,976 | B2 | 3/2019 | Waddington | |
| 10,442,600 | B2 | 10/2019 | Waltermire et al. | |
| 10,486,849 | B2 | 11/2019 | Parkes | |
| 10,934,072 | B2 | 3/2021 | Lantz et al. | |
| D921,982 | S | 6/2021 | Gerhards et al. | |
| 11,046,476 | B2 | 6/2021 | Whitehurst | |
| 2002/0052302 | A1 | 5/2002 | Clark et al. | |
| 2003/0111523 | A1 | 6/2003 | Haugan | |
| 2003/0168502 | A1 * | 9/2003 | Kisch | B65D 5/323 229/120.34 |
| 2003/0222130 | A1 | 12/2003 | Fukushima et al. | |
| 2006/0118451 | A1 | 6/2006 | Edwards | |
| 2008/0054059 | A1 | 3/2008 | Chadima | |
| 2008/0265010 | A1 | 10/2008 | Montague | |
| 2009/0032575 | A1 | 2/2009 | D Amato | |
| 2011/0204087 | A1 | 8/2011 | Kopulos et al. | |
| 2013/0037432 | A1 * | 2/2013 | Chang | B65D 5/4608 220/651 |
| 2015/0232785 | A1 | 8/2015 | Paullin et al. | |
| 2015/0267155 | A1 | 9/2015 | Brooker et al. | |
| 2016/0122445 | A1 | 5/2016 | Nambiar et al. | |
| 2017/0001752 | A1 | 1/2017 | Ishikawa et al. | |
| 2017/0036808 | A1 | 2/2017 | Everett | |
| 2017/0298308 | A1 | 10/2017 | Labeque | |
| 2018/0022498 | A1 | 1/2018 | Everett | |
| 2018/0257827 | A1 | 9/2018 | Drosos | |
| 2018/0265816 | A1 | 9/2018 | Lintula | |
| 2018/0346846 | A1 | 12/2018 | Kropf et al. | |
| 2019/0023448 | A1 | 1/2019 | Mehta | |
| 2019/0062023 | A1 | 2/2019 | Lantz | |
| 2019/0135503 | A1 | 5/2019 | De Wilde | |
| 2019/0136153 | A1 | 5/2019 | Dicosimo et al. | |
| 2019/0185893 | A1 | 6/2019 | Guan et al. | |
| 2019/0202942 | A1 | 7/2019 | Lu et al. | |
| 2019/0291917 | A1 | 9/2019 | Curcic | |
| 2019/0390138 | A1 | 12/2019 | Sivik et al. | |
| 2020/0002646 | A1 | 1/2020 | Huang et al. | |
| 2021/0047072 | A1 | 2/2021 | Ng Pak Leung et al. | |

FOREIGN PATENT DOCUMENTS

| | | | | |
|---|---|---|---|---|
| DE | 9214914 | U1 | 1/1993 | |
| EP | 0571711 | A2 | 12/1993 | |
| EP | 1783058 | A1 | 5/2007 | |
| EP | 3587293 | A1 | 1/2020 | |
| EP | 3753856 | A1 | 12/2020 | |
| FR | 2820718 | A1 | 8/2002 | |
| GB | 2081225 | A * | 2/1982 | B65D 5/441 |
| GB | 2472257 | A * | 2/2011 | B65D 5/006 |
| JP | 2018076095 | A | 4/2010 | |
| JP | 4536881 | B2 | 12/2018 | |
| WO | 2008038189 | A1 | 4/2008 | |
| WO | 2010085471 | A1 | 7/2010 | |
| WO | 2011012863 | A1 | 2/2011 | |
| WO | 2018022493 | A1 | 2/2018 | |
| WO | 2020131711 | A1 | 6/2020 | |

OTHER PUBLICATIONS

All Office Actions, U.S. Appl. No. 16/988,767, filed Aug. 10, 2020.
All Office Actions; U.S. Appl. No. 17/313,060, filed May 6, 2021.
All Office Actions; U.S. Appl. No. 17/342,574, filed Jun. 9, 2021.
All Office Actions; U.S. Appl. No. 17/342,576, filed Jun. 9, 2021.
All Office Actions; U.S. Appl. No. 17/342,577, filed Jun. 9, 2021.
All Office Actions; U.S. Appl. No. 17/475,371, filed Sep. 15, 2021.
Extended EP Search Report and Written Opinion for 20185107.8 dated Dec. 18, 2020, 8 pages.
Unpublished U.S. Appl. No. 17/313,060, filed May 6, 2021, to Paulus Antonius Augustinus Hoefte et. al.
Unpublished U.S. Appl. No. 17/342,574, filed Jun. 9, 2021, to Mark Robert Sivik et. al.
Unpublished U.S. Appl. No. 17/342,576, filed Jun. 9, 2021, to Mark Robert Sivik et. al.
Unpublished U.S. Appl. No. 17/342,577, filed Jun. 9, 2021, to Mark Robert Sivik et. al.
Unpublished U.S. Appl. No. 17/475,371, filed Sep. 15, 2021 , to Paulus Antonius Augustinus Hoefte et. al.
https://www.youtube.com/watch?v=06TdcfRR95s,pp. 3-7.
Perfumery, Practice and Principles, by Calkin and Jellinek, pub'd 1994, pp. 173-174.
Photograph of adhesive fragrance strip in Persil 3-in-1 plastic tub, 2 pages.
PCT Search Report and Written Opinion for PCT/US2021/049549 dated Nov. 23, 2021, 11 pages.

* cited by examiner

CARDBOARD SUPPORT ELEMENT

FIELD OF THE INVENTION

The present disclosure relates to a support element for a cardboard container, a lid incorporating the support element. The present disclosure also relates to a consumer product incorporating the support element, the lid and the container. The present disclosure also relates to a cardboard blank for forming the support element.

BACKGROUND OF THE INVENTION

This invention generally relates to packaging using cardboard material. Cardboard is a widely used packaging material which is particularly suited for recycling, in particular recycling in a paper recycling stream which may involve a reduced non fiber content, for example a maximum non fiber content of 5% by weight, and thereby particularly environmentally friendly. Cardboard has however limitations compared to other packaging materials such as plastic materials, in particular as far as mechanical characteristics are concerned.

SUMMARY OF THE INVENTION

The present disclosure relates to a cardboard support element for a cardboard container, the support element comprising a cardboard structure extending away from a base plane; and a first flap connected to the cardboard structure and extended in a direction normal to the base plane.

The present disclosure also relates to a lid for a cardboard container comprising a detergent product, the lid comprising a support element according to the present invention.

The present disclosure also relates to a consumer product comprising a detergent product and a container, the container comprising a box and a lid according to the present invention, the box comprising a lock to maintain the lid in a closed position, the lock comprising an actuator aligned with a portion of the cardboard structure when the lid is in the closed position, the cardboard structure fitting within the box when the lid is in the closed position.

The present disclosure also relates to a planar support element blank for a support element according to the present invention, the blank comprising a first flap, a first primary panel, a second primary panel, and a second flap following each other in this order, each flap or panel being separated from the next by at least a fold line, the fold lines being along a same linear direction.

The present disclosure also relates to a method to erect a lid according to the present invention from a planar blank assembly according to the present invention, the method comprising folding the first flank flap to form a flank of the lid, the folding of the first flank flap producing the erecting of the cardboard structure away from the top panel in a direction parallel to a direction of the folded flank to form the support element according to the present invention.

DETAILED DESCRIPTION OF THE INVENTION

Figure 1A:
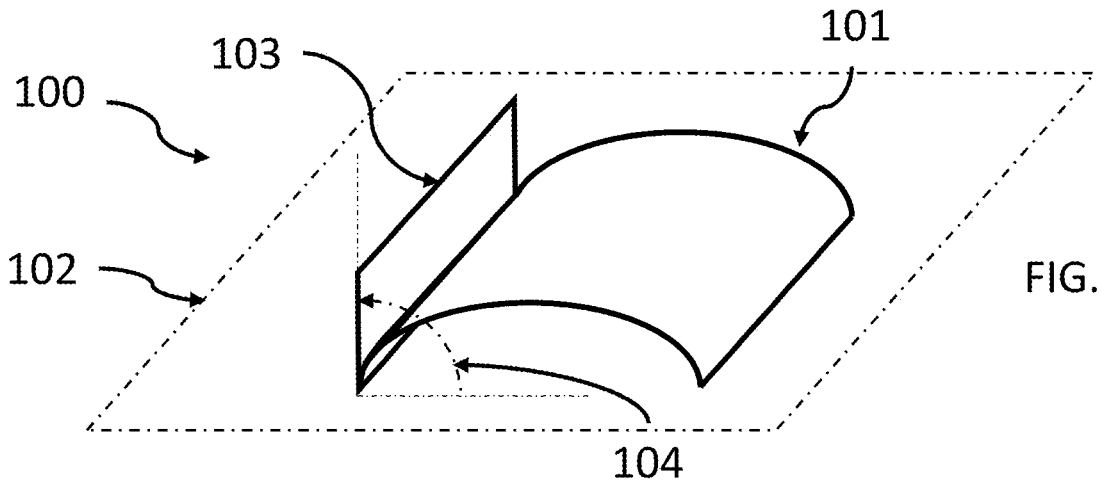
FIG. 1A-D illustrate example support elements.

Cardboard is, mechanically speaking, a relatively flexible material, meaning that a wall of a container made of cardboard may offer little resistance to getting bent under an external pressure. In some applications where resistance to getting bent is of importance, a material different from cardboard may be used. Materials different from cardboard may however not be as straightforward to recycle. Such choice of material thereby results of a compromise. An objective of the present disclosure is to propose a cardboard support element for a cardboard container, whereby the inclusion of such a support element in a cardboard container leads to reinforcement of the cardboard structure, permitting use of cardboard in applications which would otherwise be compromised by using another material.

Cardboard container design may address strengthening mechanical characteristics by applying separate three dimensional pieces. Such three dimensional pieces should be understood as pieces which may not be folded in a blank shape. Such three dimensional pieces may be applied in a lid, for example by gluing. Gluing may happen prior to or after lid formation. When gluing a three dimensional piece on a planar structure such as a blank at a supplier location, transportation from the supplier location may result less efficient due to the three dimensional nature of the three dimensional pieces. If such gluing would take place after transportation from a supplier location, for example on a manufacturing line, gluing a three dimensional piece on a blank or inside an erected lid during manufacturing may add complexity to a manufacturing operation and slow down a speed of a manufacturing line, compromising a manufacturing plant productivity accordingly. The cardboard support element according to the present disclosure was surprisingly identified as a way to create a three dimensional reinforcement structure for use in a lid which reduces or suppresses a negative impact on transportation efficiency or on manufacturing line speed in a manufacturing location. As the cardboard support element according to this description may be shaped using folding machinery which is likely to be already in place at a manufacturing location, little or no additional capital is required at a manufacturing location to implement the structures according to this disclosure. In addition to this, the gluing of two two-dimensional structures (for example a blank of the support element and a blank of a lid to form a blank assembly according to this disclosure) together may take place at a supplier facility prior to transportation to a manufacturing facility where blanks may be erected. The cardboard support according to this disclosure permits obtaining a rigid lid structure while using a relatively reduced amount of material.

A cardboard support element according to this disclosure may be made of the same material as a material used for the container or for a lid according to this disclosure. A support element, lid, box or container according to this disclosure may be made from paper or cardboard materials wherein the paper material is for example selected from paperboard, cardboard, laminates comprising at least one paper board or cardboard layer, cellulose pulp materials or a mixture thereof. The material used to make the support element, lid, box or container may comprise other ingredients, such as colorants, preservatives, plasticisers, UV stabilizers, Oxygen, perfume, recycled materials and moisture barriers or a mixture thereof. The support element, lid, box or container may comprise areas of external or internal printing. The support element, lid, box or container may be made for example by cardboard making. Suitable cardboard support element, lid, box or container manufacturing processes may include, but are not limited to, tube forming from a flat cardboard or paper sheet with a gluing step, folding or a mixture thereof. The cardboard support element, lid, box or container is opaque, for example to protect content from external light. In some examples the support element, lid, box or container is constructed at least in part and in some specific examples in its entirety from paper-based material. By paper-based material, we herein mean a material comprising paper. Without wishing to be bound by theory, by 'paper' we herein mean a material made from a cellulose-based pulp. In some examples, the paper-based material comprises paper, cardboard, or a mixture thereof, wherein preferably, cardboard comprises paper-board, corrugated fiber-board, or a mixture thereof. Corrugated fiber-board comprises a series of flutes. Each flute can be understood to be a channel. The flutes run parallel to one another, with the flute direction being the direction travelled along each channel. The paper-based material may be a laminate comprising paper, cardboard, or a mixture thereof, wherein in some examples, cardboard comprises paper-board, corrugated fiber-board, or a mixture thereof, and at least another material. In some examples, the at least another material comprises a plastic material. In some examples, the plastic material comprises polyethylene, polyethylene terephthalate, polypropylene, polyvinylalcohol or a mixture thereof. In some examples the plastic material comprises a copolymer of ethane and vinyl alcohol, or EVOH. A barrier material may be used as the at least another material. The barrier material may be a biaxially orientated polypropylene, a metallised polyethylene terephthalate or a mixture thereof. The at least another material may comprise a wax, a cellulose material, polyvinylalcohol, silica dioxide, casein based materials, or a mixture thereof. In some examples, the paper-based laminate comprises greater than 50%, preferably greater than 85%, and more preferably greater than 95% by weight of a laminate of fiber-based materials. In some examples, the barrier material may comprise plastic material having a thickness of between 10 micron and 40 micron. In some examples, the barrier material may comprise plastic material having a thickness of between 10 micron and 35 micron. The paper-based material may be a laminate. In some examples, the internal surface of a support element, lid, box or container comprises paper, cardboard, or a mixture thereof, wherein, in specific examples, cardboard comprises paper-board, corrugated fiber-board and lamination of polyethylene, or a mixture thereof, and, in some examples, the external surface of the support element, lid, box or container or a combination thereof comprises the at least another material. Alternatively, the at least another material might also be laminated in-between two paper-based material layers. Without wishing to be bound by theory this at least another material might act as a barrier for leaked liquid absorbed by the paper-based material facing the interior side of the support element, lid, box or container, to prevent or reduce a contaminating flow through a wall of the support element, lid, box or container. Other structures may be found efficient to avoid leakage from the content or to protect the content from external fluids, for example from a shower, a sink, or by handling the container or the lid with wet hands. Contamination of a wall of the support element, lid, box or container might be unsightly to consumers or may contaminate the storage area. In some examples, the support element, lid, box or container are made of a paper-based material comprising the at least another material laminated in between two corrugated fiberboard layers. In some examples, the material used for the support element, lid, box or container comprises a core cardboard flute material sandwiched between two plain cardboard layers and polyethylene laminate. A cardboard support element according to this disclosure may be made from or comprise recycled material or recycled cellulose fibres.

In some examples, the support element is a plain board support element or a corrugated fiber board support element, whereby a folding line between the first flap and the cardboard structure is along a direction taking a characteristic direction of the plain board or corrugated fiber board into account. In some examples, the cardboard support element is a plain board cardboard support element, the plain board having a fiber direction as characteristic direction, the fiber direction being normal or substantially perpendicular to folding lines and to a ridge of the cardboard support element. Such a configuration permits improving the folding behaviour of the structure, promoting a popping up of the cardboard structure extending away from the base plane. In some examples the cardboard support element is a corrugated fiber board cardboard support element, the corrugated fiber board comprising parallel flutes having a flute direction defining a characteristic direction of the corrugated fiber board, the flute direction being substantially parallel to folding lines and to a ridge of the cardboard support element material for the support element. Such a configuration comprising flutes running substantially parallel to the folding lines can improve a side to side bending resistance of the board and therefore a strength to withstand deformation when pressure is applied along a direction substantially parallel to the direction of the flutes, thereby further improving rigidity. In other words, in some examples the support element is a plain board support element or a corrugated fiber board support element, whereby a folding line between the first flap and the cardboard structure is substantially perpendicular to a fiber direction of the plain board when the support element is a plain board support element and whereby the folding line between the first flap and the cardboard structure is substantially parallel to a flute direction of the corrugated fiber board when the support element is a corrugated fiber board support element.

FIG. 1A illustrates an example cardboard support element 100 according to this disclosure. Support element 100 comprises a cardboard structure 101 extending away from a base plane 102. While base plane 102 may correspond for example to a panel such as a panel of the container, the base plane 102 may be a theoretical or virtual surface permitting describing the shape of the support element according to this disclosure. By extending away from the base plane, it should be understood that the cardboard structure comprises support parts coinciding with the base plane and at least a part extending away from the support parts, the cardboard structure developing a three dimensional shape, the cardboard material of the cardboard structure defining some boundaries of this three dimensional shape. In some examples the cardboard structure comprises a part separated from the base plane by at least 5 mm. In some examples the cardboard structure comprises a part separated from the base plane by at least 10 mm. In some examples the cardboard structure comprises a part separated from the base plane by at least 15 mm. In some examples the cardboard structure comprises a part separated from the base plane by at least 20 mm. In some examples the cardboard structure comprises a part separated from the base plane by at least 30 mm. In some examples the cardboard structure comprises a part separated from the base plane by at least 35 mm. In some examples the cardboard structure comprises a part separated from the base plane by less than 10 cm, for example to avoid a cantilever situation when the support element is acting as such. In some examples, the three dimensional shape is a portion of the cylinder or a portion of a prism. In the example illustrated in FIG. 1A, the cardboard structure 101 corresponds to a portion of a cylinder. As illustrated in FIG. 1A the cylinder has a cross section and an axis. In the example illustrated in FIG. 1A, cardboard structure 101 is formed of a single cardboard sheet. The arcuate shape taken by cardboard structure 101 may be due to the cardboard structure being tensed between other elements, such other elements being part of the support element or being part of a structure, such as a lid, different from the support element and in which the support element is located. Cardboard support element 100 comprises a first flap 103. First flap 103 may be a single flap of the cardboard support element or the cardboard element may comprise other flaps. A flap should be understood as a piece of cardboard connected to the cardboard structure. A flap may be connected to the cardboard structure by a folding line, in which case the support element may be made of an integral cardboard piece. The flap may be connected to the cardboard structure by a segment, for example the folding line, which is parallel to an axis of the cylinder or prism corresponding to the cardboard structure, the axis of the cylinder or prism being parallel to the base plan. A flap may be connected to the cardboard structure by glue. A flap may be integral to the cardboard structure or be a separate piece from the cardboard structure, while being connected to the cardboard structure to form the support element. The flap according to this disclosure extends in a direction normal to the base plane. Normal or perpendicular should be understood in this description as substantially normal or substantially perpendicular. In some examples, normal or perpendicular comprises angles of less than 120 and of more than 60 degrees. In some examples, normal or perpendicular comprises angles of less than 110 and of more than 70 degrees. In some examples, normal or perpendicular comprises angles of less than 110 and of more than 70 degrees. In some examples, normal or perpendicular comprises angles of less than 100 and of more than 80 degrees. In some examples, normal or perpendicular comprises angles of less than 95 and of more than 85 degrees. First flap 103 makes for example an angle 104 of 90 degrees with base plane 102.

The cardboard support element according to this disclosure is aimed at providing mechanical support for a cardboard wall, for example a cardboard wall of a container or of a lid of a container, such cardboard wall lying against the support element if submitted to a force or to a pressure.

Figure 1B:
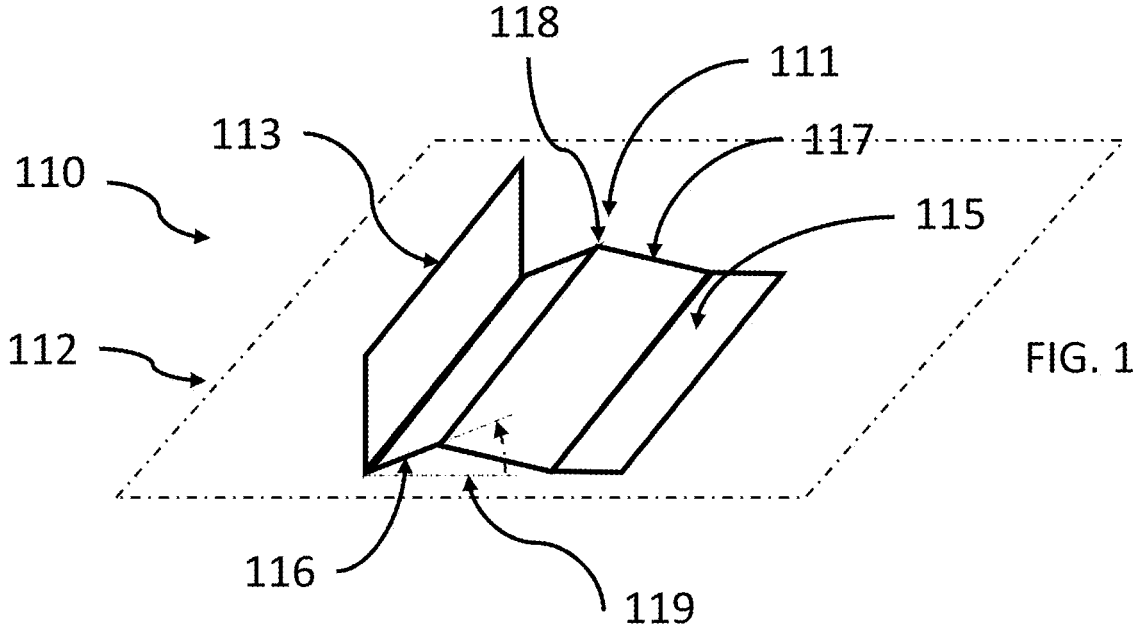

FIG. 1B illustrates another example cardboard support element 110 comprising a cardboard structure 111 extending away from a base plane 112 and a first flap 113 connected to the cardboard structure 111, the first flap 113 being extended in a direction normal to the base plane 112. In this example of FIG. 1B, the cardboard structure corresponds to portion of a prism, more specifically a triangular prism when taking the base plane 112 into account. In this example, the support element comprises a second flap 115, the second flap 115 being in this example connected to the cardboard structure 111 and extended in a direction parallel to the base plane, in this example coinciding with the base plane. In this example, the cardboard structure 111 comprises a first primary panel 116 and a second primary panel 117 connected by a linear ridge 118, the first primary panel 116 and the second primary panel 117 respectively corresponding to a first face and a second face of a prism, the ridge 118 corresponding to an edge of the prism connecting the first and the second face, the first 116 and second 117 primary panels preferably making an angle of more than 15 degrees with the base plane. In this case, the primary panel makes an angle 116 of about 30 degrees with the base plane. In this example, the first flap 113 is directly connected to the first primary panel 116 and the second flap 115 is directly connected to the second primary panel 117. In some examples the ridge is separated from the base plane by at least 5 mm. In some examples the ridge is separated from the base plane by at least 10 mm. In some examples the ridge is separated from the base plane by at least 15 mm. In some examples the ridge is separated from the base plane by at least 20 mm. In some examples the ridge is separated from the base plane by at least 30 mm. In some examples the ridge is separated from the base plane by at least 35 mm. In some examples the ridge is separated from the base plane by less than 10 cm, for example to avoid a cantilever situation when the support element is acting as such.

Figure 1C:
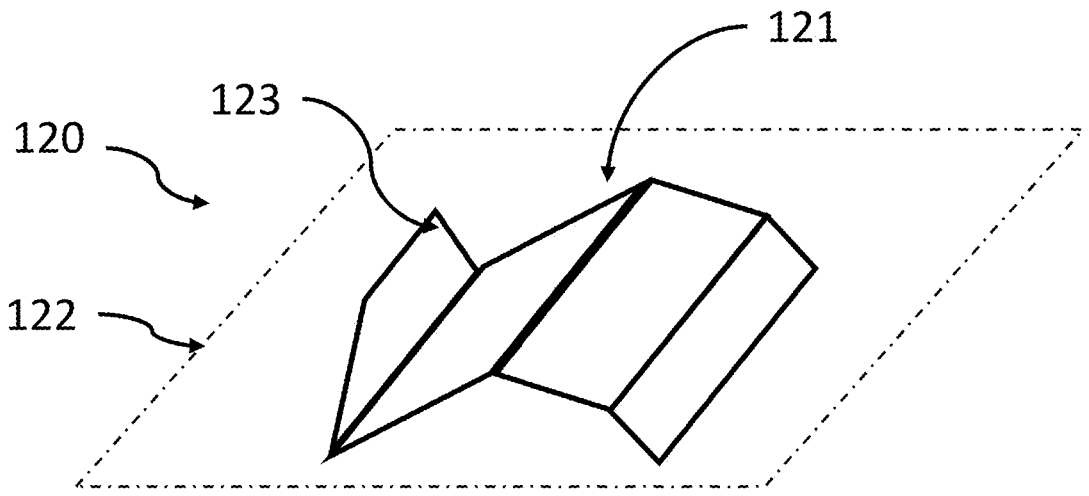

FIG. 1C illustrates another example cardboard support element 120 comprising a cardboard structure 121 extending away from a base plane 122 and a single first flap 123 connected to the cardboard structure 121, the first flap 123 being extended in a direction normal to the base plane 122. In this example of FIG. 1C, the cardboard structure corresponds to portion of a prism, more specifically a tetragonal prism when taking the base plane 122 into account.

Figure 1D:
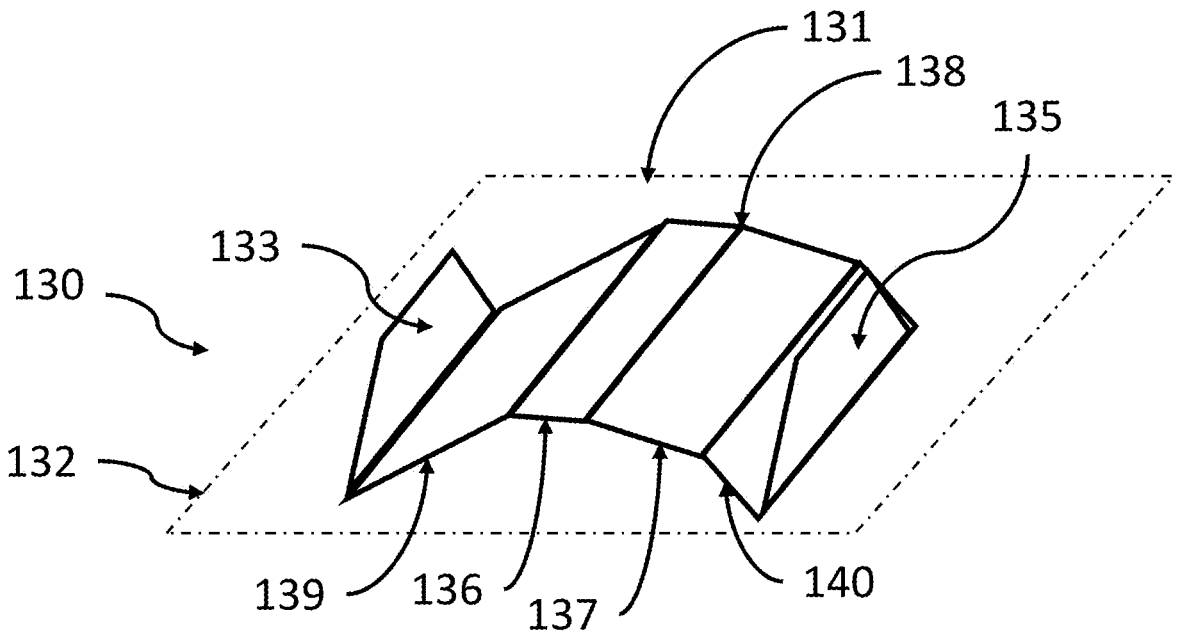

FIG. 1D illustrates another example cardboard support element 130 comprising a cardboard structure 131 extending away from a base plane 132 and a first flap 133 connected to the cardboard structure 131, the first flap 133 being extended in a direction normal to the base plane 132. In this example of FIG. 1D, the cardboard structure corresponds to portion of a prism, more specifically a pentagonal prism when taking the base plane 132 into account. In this example, the support element comprises a second flap 135, the second flap 135 being in this example connected to the cardboard structure 131 and extended in a direction normal to the base plane. In this example, the cardboard structure 131 comprises a first primary panel 136 and a second primary panel 137 connected by a linear ridge 138, the first primary panel 136 and the second primary panel 137 respectively corresponding to a first face and a second face of a prism, the ridge 138 corresponding to an edge of the prism connecting the first and the second face. In this example the support element further comprising a first secondary panel 139 and a second secondary panel 140, the first secondary panel 139 connecting the first flap 133 and the first primary panel 136, the second secondary panel 140 connecting the second flap 135 and the second primary panel 137, whereby fold lines separate the first flap 133 from the first secondary panel 139, the first secondary panel 139 from the first primary panel 136, the first primary panel 136 from the second primary panel 137, the second primary panel 137 from the second secondary panel 140 and the second secondary panel 140 from the second flap 135, the fold lines being parallel to the linear ridge 138, which is itself parallel to the axis of the prism. In this example, the first flap 133 is indirectly connected to the first primary panel 136 by way of the first secondary panel 139 and the second flap 135 is indirectly connected to the second primary panel 137 by way of the second secondary panel 140.

It should be understood that features such as number of flaps, flap orientations, number of panels and angles of various examples hereby described may be combined to produce alternative examples.

Figure 2:
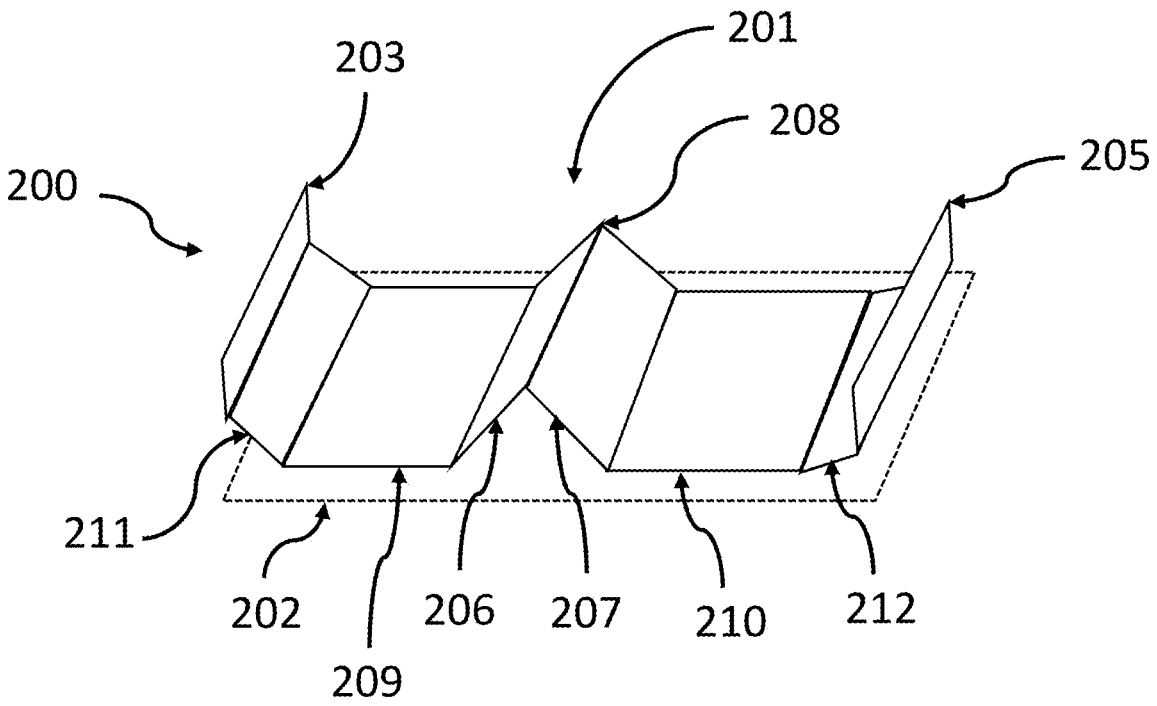
FIG. 2 illustrates another example support element.

FIG. 2 illustrates yet another example cardboard support element 200 comprising a cardboard structure 201 extending away from a base plane 202 and a first flap 203 connected to the cardboard structure 201, the first flap 203 being extended in a direction normal to the base plane 202. In this example of FIG. 2, the cardboard structure 201 corresponds to a portion of a prism, more specifically a triangular prism when taking the base plane 202 into account. In this example, the support element comprises a second flap 205, the second flap 205 being in this example connected to the cardboard structure 201 and extended in a direction normal to the base plane 202. In this example, the cardboard structure 201 comprises a first primary panel 206 and a second primary panel 207 connected by a linear ridge 208, the first primary panel 206 and the second primary panel 207 respectively corresponding to a first face and a second face of a prism, the ridge 208 corresponding to an edge of the prism connecting the first and the second face. In this example the support element further comprising a first secondary panel 209 and a second secondary panel 210, the first secondary panel 209 indirectly connecting the first flap 203 and the first primary panel 206, the second secondary panel 210 indirectly connecting the second flap 205 and the second primary panel 207. In this example, the support element 200 further comprising a first tertiary panel 211 and a second tertiary panel 212, the first tertiary panel 211 directly connecting the first flap 203 and the first secondary panel 209, the second tertiary panel 212 connecting the second flap 205 and the second secondary panel 210, whereby fold lines separate the first flap 203 from the first tertiary panel 211, the first tertiary panel 211 from the first secondary panel 209, the first secondary panel 209 from the first primary panel 206, the first primary panel 206 from the second primary panel 207, the second primary panel 207 from the second secondary panel 210, the second secondary panel 210 from the second tertiary panel 212 and the second tertiary panel 212 from the second flap 205, the fold lines being parallel to the linear ridge 208, whereby the first and second secondary panels each make an angle comprised between 0 and 10 degrees with the base plane and whereby the first and second tertiary panels preferably each make an angle of more than 15 degrees with the base plane. In this specific example, the first secondary panel 209 and the second secondary panel 210 are parallel to the base plane 202.

Figure 3:
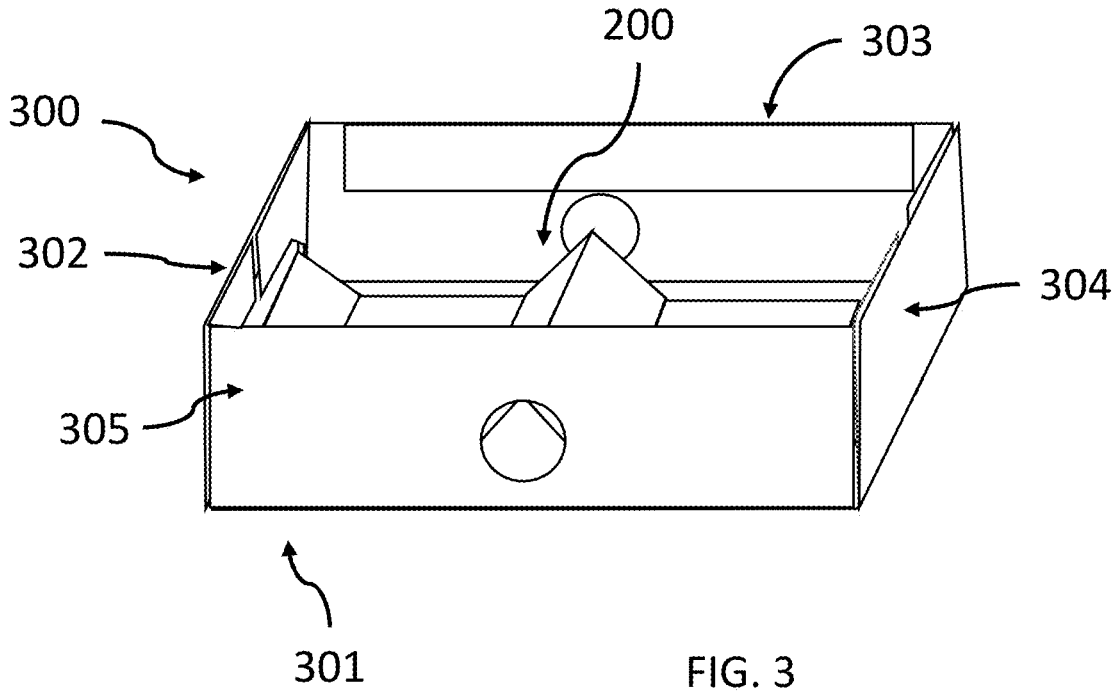
FIG. 3 illustrates an example lid.

FIG. 3 illustrates a lid 300 for a cardboard container comprising a detergent product, the lid 300 comprising a support element. While the support element may be any support element according to this description, the lid 300 is here illustrated with support element 200 illustrated in FIG. 2. Lid 300 is illustrated upside down in order to clearly visualize support element 200. In this example, the lid is illustrated as comprising a single support element according to this disclosure. A lid according to this disclosure may however comprise one or more additional supports. Using one or more additional support elements may permit saving material while obtaining the effect of a support element on different sides of a lid. Using a single support element may permit compensating opposed forces on opposed sides of a lid on the single support element. In a preferred embodiment, a single support is used, use of a single support reducing manufacturing complexity. In another preferred embodiment, two support elements are used on a single lid, such two support element being placed against opposite flanks, such two support elements being substantially parallel to each other, such two support element having respective apex which may be aligned or which may correspond to different relative positions, such respective apex being preferably aligned to correspond to positions of fingers of a consumer gripping the lid. The use of two support elements has the advantage of enabling use of less material than for a single support element, whereby the two support elements may be separated by a gap between the two support elements.

The lid 300 comprises a top 301 (here illustrated at the bottom due to the lid being upside down to offer a good vision of the support element) and flanks 302-305, the top 301 being parallel to the base plane 202, the first flap 203 being affixed to a first flank 302 of the flanks, the support element 200 comprising a second flap 205 connected to the cardboard structure 201 and extended in a direction normal to the base plane 202. The second flap may also be parallel to the base plane 202. The second flap is affixed to a second flank of the flanks, the first flank being opposite to the second flank. The second flap may alternatively be affixed to the top. In this and other examples, one should note that when the lid is in the closed position and placed on top of the container, sidewalls of the container would be inserted against the first flap and thereby participate to rigidity of the entire assembly formed by the container closed by the lid.

Figure 4:
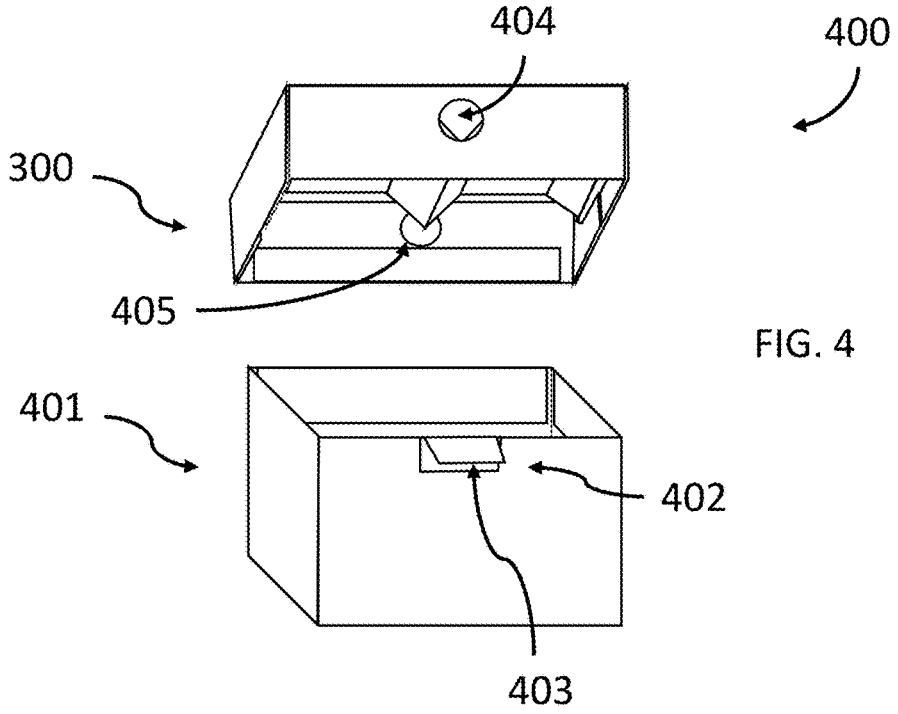
FIG. 4 illustrates an example consumer product.

FIG. 4 illustrates a consumer product 400 comprising a detergent product (not illustrated) and a container, the container comprising a box 401 and a lid such as lid 300 comprising a support element according to this disclosure, the box 401 comprising a lock 402 to maintain the lid 300 in a closed position, the lock 402 comprising an actuator 403 aligned with a portion of the cardboard structure 201 when the lid 300 is in the closed position, the cardboard structure 201 fitting within the box 401 when the lid 300 is in the closed position.

Detergent products are products which may be relatively heavy, for example when a container for such product is carrying the full weight of such detergent products, in particular when the consumer product is recently acquired and thereby holds a significant quantity of detergent product. While some consumers may lift and transport such a consumer product holding a base of a box containing such detergent product, such lifting and transport may also occur by holding such consumer product by a lid, without holding the base. In such cases, it is possible that the lid, submitted to the force of gravity of the detergent product, gets released and opens the box, the box falling and possibly spreading its content. Such situations should be avoided. Beyond avoiding such unintentional lid unlocking, the structure of the container of a consumer product should preserve or improve opening ergonomics and prevent or reduce a permanent side wall deformation upon excessive or repetitive application of forces applied to the consumer product, for example during transport, in a grocery shopping bag against other objects, when submitted to external pressure, or when dropped. At the same time, containers may be elaborated in order to preserve the environment. The consumer product according to this disclosure aims at taking these different aspects into account.

A consumer product should in this disclosure be understood as a product which is provided, among others, to end consumers. Such consumer products may for example be available for purchase in supermarkets and end consumers may store such consumer products in their homes. Consumer products may be provided in large quantities and should thereby be designed taking environmental concerns into account. Consumer products should also be designed taking transportation to a retail store into account. Consumer products should also be designed taking on the shelf storage in a retail store into account. Consumer products should also be designed taking transportation from a retail store to a consumer home into account. Consumer products should also be designed taking storage at a private end consumer home into account. Consumer products should also be designed taking use of the consumer product at a private end consumer home into account. Consumer products should also be designed taking disposal into account.

The consumer product according to this disclosure comprises a detergent product. Detergent products should be understood in this disclosure as products comprising a surfactant. Detergent products may also comprise a bleach or other ingredients. Example detergent product compositions are described in more detail herein. In some examples, the detergent product comprises unit dose detergent pouches, preferably water soluble unit dose detergent pouches, more preferably flexible water soluble unit dose detergent pouches. Example unit dose detergent pouches are described in more detail herein.

The consumer product according to this disclosure further comprises a container. A container should be understood in this disclosure as an object housing a content, for example in a cavity of the container. The container facilitates protection, transport, storage, access and disposal of the consumer product. In this disclosure, the container comprises a box. A box should be understood as a generally parallelepiped, barrel shaped, cylindrical, round, oval or cubical three dimensional object defining a cavity. The use of parallelepiped boxes may facilitate storage and transportation by permitting piling up boxes in a space efficient manner. In some examples, a box may be a parallelepiped provided with some rounded, tapered trapezium or chamfered edges. The box according to this disclosure comprises the detergent product. It should be understood that the detergent product is contained or stored in the box. The box according to this disclosure may comprise a base, sidewalls and an opening. A base according to this disclosure should be understood as a surface on which the box may lie when placed on a supporting surface such as a shelf or a floor. In some examples, the base is flat. In some examples, the base is rectangular. In some examples, the base is oval or round. In some examples, the base is flat. In some examples, the base has an embossed profile standing in or out in relief. The sidewalls according to this disclosure should be understood as extending from the base, and connecting the base to the opening, to a transition piece or to the lid. It should be understood that the connection of the base to the opening may include a transition piece in addition to a sidewall. A transition piece may be glued or otherwise attached to the sidewall for example. In some examples, the sidewalls are perpendicular to the base. In some examples, the base is rectangular and has four sides, four sidewalls extending perpendicular from the base, each sidewall being rectangular, each side wall being connected by a sidewall side to a side of the base, and by two other sidewall sides to two other of the four sidewalls. In some examples the base is oval or circular and the sidewalls form a generally cylindrical wall extending from the base in a direction normal or perpendicular to the base. In some examples, sidewalls have a shape corresponding to one of a square, a rectangle, a trapeze, a section of a sphere, a section of an ovoid, or a section of an ellipsoid. The opening according to this disclosure should be understood as an aperture providing access to the detergent product comprised in the box. In some examples, the opening faces the base. In some examples, the opening has a surface of less than the surface of the base. In some examples, the opening has a surface larger than the surface of the base in order to provide an improved access, for example using sidewalls extending from the base at angle of more than 90 degrees from the base. In some examples, the opening is provided after removal of a tamper proof feature, for example comprising a perforated piece to be removed at first use or a tamper evident sticker locking the lid to the box or tray. In some examples, the opening is placed on a top panel of the box, the top panel of the box facing the base of the box, the top panel of the box being separated from the base of the box by at least the sidewalls, the top panel of the box being generally coplanar with the base of the box, whereby the opening covers a portion of the top panel, the top panel comprising a peripheral section surrounding the opening, the peripheral section being a transition piece between a sidewall and the opening for example. In some examples, the opening is rectangular. In some examples, the opening is rectangular with rounded edges. In some examples, the opening is round or oval. The lid according to this disclosure should be understood as an element permitting to repeatedly close or open the opening of the container. In some examples the lid may be connected to the box, for example by a hinge, or may be separated from the box. The lid according to this disclosure may comprise a top and flanks. It should be understood that the top of the lid is aimed at covering the opening of the box when the lid is in a closed position. In some examples, the top of the lid is rectangular. In some examples the top of the lid is round, hexagonal, octagonal, or oval. In some examples, the lid comprises beveled edges. In some examples, the top of the lid is rectangular with rounded edges. It should be understood that while being named "top", the top of the lid may be positioned in different orientations. The lid may comprise flanks. It should be understood that the flanks according to this disclosure are elements connected to the top of the lid and extending from the lid in order to engage one or more sidewalls of the box. The flanks participate in placing the top of the lid onto the opening. In some examples, the flanks extend perpendicularly from the top of the lid. In some examples, the flanks surround an entire perimeter of the top of the lid. In some examples, the flanks partially surround an entire perimeter of the top of the lid, a portion of the top of the lid being flankless. The top of the lid may cover the opening, and at least a portion of the flanks may cover at least a specific portion of the sidewalls when the lid is in the closed position, the lid being moveable from the closed position to an open position. Movement of the lid may be restrained by a connection to the box such as a hinge, or may be entirely removable, for example to provide an improved access to the content of the box. The box and lid cooperate to participate in fulfilling the role of the container to store, transport and facilitate access to the content of the container.

The container according to this disclosure comprises a lock. A lock should be in this disclosure understood as a mechanism preventing or reducing the likelihood of an accidental opening. The lock according to this disclosure is to maintain the lid in a closed position. It should be understood that the lock according to this disclosure is expected to function under normal use of the container. It should be understood that the lock may not fulfill its function when for example unusual use is made of the box, or when the box is under unusual conditions. According to this disclosure, the lock comprises an actuator moveable from a locking position to an opening position by applying an actuation pressure onto the actuator when the lid is in the closed position. The actuator should be understood in this disclosure as a mechanical structure submitted to a movement upon actuation by an outside force or actuation pressure, such movement leading to the opening of the lock when such movement takes place. In some examples, the actuator according to this disclosure is resilient and has a default position, such default position corresponding to the lid remaining closed, the resilience being vanquished by an outside force or actuation pressure in order to open the lid. In some examples, the actuator is resilient in that the actuator comprises a flexible element, the flexible element having a default position corresponding to the lid remaining closed, the flexible element being pressed to open the lid, the flexible element springing back to the default position when releasing pressure. It should be understood that a pressure is generated by the application of a force onto a surface. The actuator according to this disclosure has at least two positions being an opening position and a locking position, whereby the opening position corresponds to a position permitting opening of the lid, the locking position preventing opening of the lid or reducing the possibility of an accidental opening of the lid.

The actuator according to this disclosure is may be connected to a specific portion of sidewalls of the box, which may be a specific portion covered by at least a portion of the flanks when the lid is in the closed position, the actuator abutting against a locking tab of the flanks when in the locking position, the actuator being maintained away from the locking tab when in the opening position, the actuator being displaceable by the actuation pressure by an unlocking displacement distance in a direction normal to the specific portion of the sidewalls. The connection of the actuator to the specific portion of the sidewall is due to the actuator participating in locking or unlocking the specific portion of the sidewall from the portion of the flanks covering the specific portion of the sidewall, thereby permitting releasing the lid from the box. The flanks may comprise a locking tab. A locking tab should be understood as a mechanical element which interlocks with the actuator. In some examples the locking tab extends away from the flanks and may be in the form of a bulge, a ridge, an embossment or an additional material layer sticking out of the flanks of the lid and towards the specific portion of the side wall such that the actuator may abut against the tab when in the locking position to prevent separating the specific portion of the sidewalls from the flank in the area of the actuator. In some examples, the locking tab is comprised in the flank itself, the locking tab being for example formed by an aperture in the flanks. Abutment according to this disclosure should be understood as a contact between the actuator or part of the actuator and the tab, such contact preventing opening of the lid. The actuator is maintained away from the locking tab when in the opening position, in order to release the locking tab. Such release of the locking tab permits opening the lid. Displacement or movement of the actuator from the locking to the opening position is by application on the actuator (directly or indirectly) of an actuation pressure or force such that the actuator is displaced by a distance sufficient to suppress contact of the actuator with the locking tab, such distance corresponding to the displacement distance, in a direction normal to the specific portion of the side wall. It should be understood that the force or pressure leading to the displacement may have a number of different directions, such different directions contributing to the displacement if a component of such force or pressure is in a direction normal to the specific portion of the side wall. Such force or pressure may also comprise a component which may be parallel to the side wall. The actuation is however triggered by a component of such force or pressure being normal to the portion of the side wall. Such presence of a component normal to the portion of the sidewall participates in the role of the lock of avoiding an accidental opening by lifting the container through lifting the lid by applying a force parallel to the sidewall, whereas desired opening would take place by the consumer "pushing" the actuator and apply the unlocking force or pressure permitting opening of the lid. In other words, while a consumer may apply a force on the actuator along a direction which may not be normal to the sidewall, if a component of such force is normal to the sidewall such component may participate in applying the pressure leading to the displacement.

Such a lock would participate in suppressing or reducing the risk of accidental opening of the lid while permitting desired opening by a consumer, the functioning of such a lock depending on ensuring that the actuator maintains abutting against the locking tab even in case of pulling strongly on the lid in a direction parallel to the side wall in order to transport or lift the consumer product. The avoidance or reduction of the risk of accidental opening would also apply to a force being applied in a direction parallel to the sidewalls for example by friction with another box located side to side with a box according to this disclosure, or by a box falling over during transportation, or by internal movements of the content of the box pushing the lid during transportation. Strong pulling in a direction parallel to the sidewall may however impact the structure of the sidewall, for example resulting in bending of the side wall, whereby such bending may produce undesired disengagement of the locking tab from the activator, due to the fact that the actuator is connected to the specific portion of the sidewall. This would lead to an undesired opening of the lid. Such undesired opening of the lid may be more likely if the sidewall is made of a material such as cardboard used to form the sidewalls, in particular when the box is a cardboard box.

In some examples, the lock is placed in a central area of a sidewall of the box. A central area should be understood as substantially equidistant from opposite edges of the sidewall concerned, such edges being along a direction normal to the base of the box. In such examples, it should be understood that the lock is located closest to an edge of the sidewall close to the opening than to an edge of the sidewall close to the base, while being in a central area in respect to the edges normal to the base. Such central location of the lock may participate in avoiding sliding of the lid from the box if the box is lifted by holding the lid by applying pressure onto the actuator, whereby such pressure presses the actuator against the support element centrally, thereby balancing the forces maintaining the connection between the lid and the box and participating in avoiding accidental opening. In some examples, the lock may be located on a sidewall and between two edges of the sidewall, such edges being normal to the base, the lock being closer to one edge than to the other edge of the two edges, for example located closer to the one edge at a ⅓ of the distance between the two edges. In some examples one sidewall may comprise two locks.

The present disclosure aims at resolving this apparent contradiction between, on one hand, the use of materials for the sidewalls which would resist accidental opening, and the use of materials for the sidewalls which are particularly environmentally friendly.

The container may be made from rigid cardboard material, flexible cardboard material or a mixture thereof. In some example, the material forming the box or the lid has a wall thickness of more than 300 microns and of less than 3 mm. In some example, the material forming the box or the lid has a wall thickness of more than 1 mm and of less than 2 mm. In some example, the material forming the box or the lid is folded on itself, for example to reinforce parts of or the whole of the box or the lid. The container may be made from paper materials, bio based material, bamboo fibres, cellulose fibres, cellulose based or fibre based materials, or a mixture thereof. The container may be made from materials comprising recycled materials, for example recycled cellulose fiber based materials.

The lid according to this disclosure indeed further comprises a support element, the support element entering the opening when the lid is in the closed position, at least part of the specific portion of the sidewalls being located between the flanks and the support element when the lid is in the closed position, a clearance distance separating the sidewalls from the support element in a direction normal to the specific portion of the sidewalls when the lid is in the closed position and when no actuation pressure is applied, the clearance distance being reduced to zero by flexing of the specific portion of the sidewalls when the actuation pressure is applied above a pressure threshold when the lid is in the closed position. Both the support element and the flanks are structurally part of the lid, the support element and the flanks permitting sandwiching the specific portion of the sidewall, thereby preventing sinking in of the specific portion of the sidewall and undesired disengagement of the actuator from the locking tab. It is important to take note of the fact that in case of an actuation pressure being applied while lifting the box through the lid, the pressure applied will catch the sandwiched specific portion of the sidewall against the support element, thereby compensating a force of gravity which would otherwise disconnect the lid from the box, such compensation of the gravity force being through a resisting static friction force between the specific portion of the sidewall and the support element. In some examples, the use of the support element permits using for making the box a relatively flexible material, whereby such flexible material would flex in the absence of the support element to the point that the box would fall off if lifted by its lid. Permitting using a relatively flexible material also permits using a lesser quantity of such material due to the presence of the support element which compensates for such flexibility. The presence of such support element thereby prevents or reduces the risk of accidental opening even if the actuation pressure is applied onto the actuator of the lock, for example as the box is lifted while applying pressure on the actuator of the lock.

The support element may in some example be made of the same material as a material used for making the top of the lid. In some examples the support element is made of a material different from the material used for the top of the lid. The support element enters the opening when the lid is in the closed position. Such entering the opening should be understood in that the support element comprises a support element portion which enters the opening when the lid is moved from the open to the closed position, and whereby such support element portion exits the opening when the lid is moved from the closed to the open position. At least part of the specific portion of the sidewalls is located between the flanks and the support element when the lid is in the closed position. This structure permits capturing the specific portion of the sidewall between the flanks and the support element, the specific portion of the sidewall getting inserted between the flanks and the support element when the lid moves from the open to the closed position, the specific portion of the side wall being released from between the flanks and the support element when the lid moves from the closed to the open position. A clearance distance separates the sidewalls from the support element in a direction normal to the specific portion of the sidewalls when the lid is in the closed position, such direction corresponding for example to a direction of the linear ridge, and when no actuation pressure is applied. Such clearance distance would exist on a first side, and be repeated additionally on a second side of the support element. Such clearance distance permits insertion of the support element through the opening as the lid gets closed, such that the support element does not collide with the specific portion of the sidewall when the lid gets closed. The clearance is reduced to zero by flexing of the specific portion of the sidewalls when the actuation pressure is applied above a pressure threshold when the lid is in the closed position. When such pressure threshold is reached, the sidewall lays against the support element through the clearance distance being reduced to zero, the sidewall thereby being prevented from being exceedingly distorted and being prevented from sinking in to the point of the actuator releasing the locking tab. The clearance distance according to this disclosure relates in some examples to a tolerance distance between the lid and the box which both permits placing the lid onto the box without undue difficulty, while avoiding that the lid be loose when in the closed position. While the clearance distance according to this disclosure is considered in a region of the lock, the tolerance distance between the lid and the box may be considered along an entire perimeter of the opening of the box. In some examples, the tolerance is of at least 0.1 mm and of less than 5 mm. In some examples the tolerance is of at least 1 mm and of less than 3 mm Such tolerance would for example be measured when the lid is in the closed position and between an internal surface of the flanks and an external surface of the sidewalls, understanding that such tolerance may take a different value in a region of the lock.

In some examples, the clearance distance is of at least 1 mm and of less than 1 cm when the lid is in the closed position and no actuation pressure is applied. Such a range permits both easing the closing of the lid and preventing sinking of the specific portion of the sidewall leading to undesired unlocking. In some examples, the clearance distance is of at least 1.5 mm and of less than 0.5 cm when the lid is in the closed position and no actuation pressure is applied. In some examples, the clearance distance is of at least 2 mm and of less than 0.4 cm when the lid is in the closed position and no actuation pressure is applied.

In some examples, as for example illustrated in FIG. 4, the actuator comprises a flap 403 connected by a hinge portion to a specific portion of the sidewalls of the box, the flap extending from the hinge portion to a distal edge of the flap, the hinge portion being located between the flanks and the support element when the lid is in the closed position, the distal edge extending away from the specific portion of the sidewalls and the distal edge of the flap abutting against the locking tab of the flanks when in the locking position, the flap lying flush against the specific portion of the sidewalls and the distal edge being maintained away from the locking tab when in the opening position, the actuation pressure displacing the flap by an acute actuation angle from the closing position to the opening position, the acute angle corresponding to displacing the distal edge by the unlocking displacement distance. In some examples, the acute angle is between 5 and 60 degrees. In some examples, the acute angle is between 5 and 45 degrees. In some examples, the acute angle is between 5 and 20 degrees. In some examples the acute angle is a function of the length of the locking flap in a direction generally parallel to the specific portion and of a thickness of the locking tab and of tolerances between the sidewalls of the box and the flanks of the lid and of a tolerance between the sidewalls of the box and the flap, or patch as disclosed below. In some examples horizontal displacement (along a direction substantially normal to a sidewall comprising the specific section) measured at the end of the locking flap abutting with the locking tab is of at least a thickness of the locking tab along a direction substantially normal to a sidewall comprising the specific section. In some examples such horizontal displacement is comprised between 0.3 mm and 30 mm. In some examples a length of the flap has a length along a direction generally normal to the base of the box larger than the sum of different tolerances comprising a play between the locking tab and the flap in the abutment area when the lid is in the closed position and the container is not submitted to external pressure, a tolerance between the flanks of the lid and the sidewalls of the box, and the tolerance between the side walls of the box and the flap and a bending deformation of the flap. In some examples the locking flap has a length along a direction generally normal to the base of the box of at least 3 mm and of less than 60 mm. In some examples the locking flap has a length along a direction generally normal to the base of the box of at least 15 mm and of less than 45 mm. In some examples the locking flap has a length along a direction generally normal to the base of the box of at least 25 mm and of less than 35 mm. In some examples, the flap has a width along a direction perpendicular to its length and parallel to the specific portion of between 5 mm and 60 mm Such example width dimensions may permit easing disengaging the lock by limiting its width while avoiding a risk of the lock getting distorted by pressure by providing the lock with a sufficient width. Such dimensioning selection may be dependent on the material selected for the different parts forming the container. Such a flap may be used in examples or configurations differing from the ones illustrate in FIG. 4.

In some examples, not illustrated here, the actuator comprises a patch glued to the specific portion of the sidewalls. Such patch may for example be a piece of material of the same nature as a material used for the making of the box or of the lid, such piece of material being for example glued to the box, the piece of material being structurally separate from the box, the piece of material interacting with the locking tab, the piece of material comprising for example a fold line defining a first part interacting with the locking tab and a second part glued to the box, thereby functioning as the flap hereby described.

In some examples such as illustrated in FIG. 4, the support element 200 comprises a support area, the support area comprising an area of contact with the specific portion of the sidewall when the clearance is reduced to zero by flexing of the specific portion of the sidewalls when the actuation pressure is applied above the pressure threshold when the lid is in the closed position, whereby the area of contact faces the actuator 403 along a direction normal to the specific portion of the side walls. Bringing such area of contact at the level of the actuator permits improving the resiliency of the structure, whereby the actuation pressure will be directly absorbed by the support element once the clearance distance which separates the sidewalls from the support element is reduced to zero and the actuator makes direct contact with the support element at the area of contact.

The example consumer product 400 comprises a lock 402 as illustrated in FIG. 4. The consumer product 400 also comprises an additional lock (not illustrated). Indeed, in this example and in some other examples, the consumer product comprises an additional lock, the additional lock comprising an additional actuator connected to an additional specific portion of the sidewalls, the specific portion of the sidewalls being comprised in a first sidewall of the box, the additional specific portion of the sidewalls being comprised in a second sidewall of the box, the first sidewall being opposite to the second sidewall. The consumer product 400 comprises actuator 403 of the lock 402 and additional actuator of lock. It should be understood that in this example and in some other examples comprising an additional lock, such additional lock may have a structure similar to or different from the lock according to this disclosure. In some examples, the additional lock has a structure corresponding to the structure of the lock according to this disclosure. In some examples, the additional lock has a structure differing from the structure of the lock according to this disclosure. In some examples, an additional lock is provided according to this disclosure on a same sidewall as the lock according to this disclosure. In some examples, an additional lock is provided on a sidewall adjacent to the sidewall comprising the lock.

In the example illustrated in FIG. 4, the flanks of the lid comprise an actuation area 404 and an additional actuation area 405. Indeed, in this example and in some other examples, the flanks of the lid comprise an actuation area facing the actuator and permitting displacing the actuator from the closing position to the opening position by applying the actuation pressure at the actuation area when the lid is in the closed position, whereby the actuation area comprises one or more of an actuation aperture, an actuation flap, an actuation slit or an actuation membrane, whereby the actuation area further comprises a visual indication indicating the location of the actuation area. In the example illustrated in FIGS. 4 and 9A, the actuation areas 404 and 405 each comprise an actuation aperture. The visual indication may be printed on an external surface of the flanks and may comprise one or more arrows or one or more areas printed in a striking colour or a specific text providing instructions such as "push here to open" for example, or a combination of any of these indications.

In the example illustrated in FIG. 4 and in some other examples not illustrated here, the flanks comprise the additional actuation area 405 facing the additional actuator and permitting displacing the additional actuator, the actuation area 404 and the additional actuation area 405 being separated by a peripheral path along an exterior surface of the lid, the peripheral path measuring less than 20 cm and more than 9 cm. In some examples, this peripheral path is the shortest peripheral path between a top of the actuation area and a top of the additional actuation area, such top being a point of the respective actuation area or additional actuation area closest to the top of the lid. In some examples, the peripheral path measures less than 15 cm and more than 11 cm. In some examples, the peripheral path measures less than 14 cm and more than 12 cm. The length of such peripheral path may advantageously permit an adult user to apply a thumb of one hand on the actuator and the index (or middle finger) of the same one hand on the additional actuator at the same time in order to press on both the actuator additional and the additional actuator simultaneously with one hand in order to unlock the lid and open the lid. In other examples, two locks may be provided on a same sidewall, opening taking place by actuating on both locks, for examples using both thumbs.

In the example consumer product 400, actuation areas 404 and 405 are separated in a straight line from the outside surface of the respective flanks where they are located by a distance, whereby such distance is of more than 6 cm and of less than 12 cm. In some examples, the distance is of about 8 cm. In some examples, the distance is of more than 7.5 cm and of less than 8.5 cm. In some examples, the distance is of more than 8.4 cm and of less than 10.4 cm. In some examples, the distance is of more than 8.9 cm and of less than 9.9 cm. In some examples, the distance is of about 9.4 cm. In some examples, the clearance distances which separates the sidewalls from the support element are each of between 1 mm and 4 mm when no actuation pressure is applied. In some examples, the clearance distances are each of between 3 mm and 4 mm when no actuation pressure is applied.

In the example illustrated in FIG. 4, each lock is separated from a respective gable of the support element by a clearance distance. In this example and in some other examples according to this disclosure, the support element comprises a resilient structure concurrently in contact with both the specific portion and the additional specific portion when flexing of both the specific portion of the first sidewall and the additional specific portion of the second sidewall when the actuation pressure is applied above the pressure threshold on both the actuator and the additional actuator when the lid is in the closed position. In such a configuration the resilient structure of the actuator absorbs any excess pressure applied onto the actuators in order to open the lid. In some examples, the resilient structure, or cardboard structure, is unitary, for example to facilitate manufacturing. Unitary should be understood as being made from an integral piece of material. In some examples, the resilient structure comprises a plurality of substructures, for example to facilitate assembly.

In some examples the flanks of the lid cover about 30% of the sidewalls of the box, 30% corresponding in this case to a ratio between on one hand a height of the flanks in a direction normal to both the top of the lid and the base of the box and on the other hand the height of the sidewalls in the direction normal to both the top of the lid and the base of the box. In an example, the flanks completely surround the sidewalls around the opening. Such coverage of the flanks participates in ensuring lid placement, structural resiliency and protection of the content. In some examples, the flanks cover at least 30% of the sidewalls when the lid is in the closed position. In some examples, the flanks cover at least 35% of the sidewalls when the lid is in the closed position. In some examples, the flanks cover at least 40% of the sidewalls when the lid is in the closed position. In some examples, the flanks cover at most 90% of the sidewalls when the lid is in the closed position. In some examples, the flanks cover at most 80% of the sidewalls when the lid is in the closed position. In some examples, the flanks cover at most 70% of the sidewalls when the lid is in the closed position. In some examples, a manufacturing process comprises providing different box sizes, for example boxes having a sidewall height of either 10 cm, 11.5 cm, 13.5 cm or 16 cm, whereby each box may be provided with a same lid fitting all box sizes provided, such as a lid having a flank height of 7 cm. In some examples, flank height is of more than 3 cm. In some examples, flank height is of more than 5 cm. In some examples, flank height is of more than 6 cm.

Figure 5:
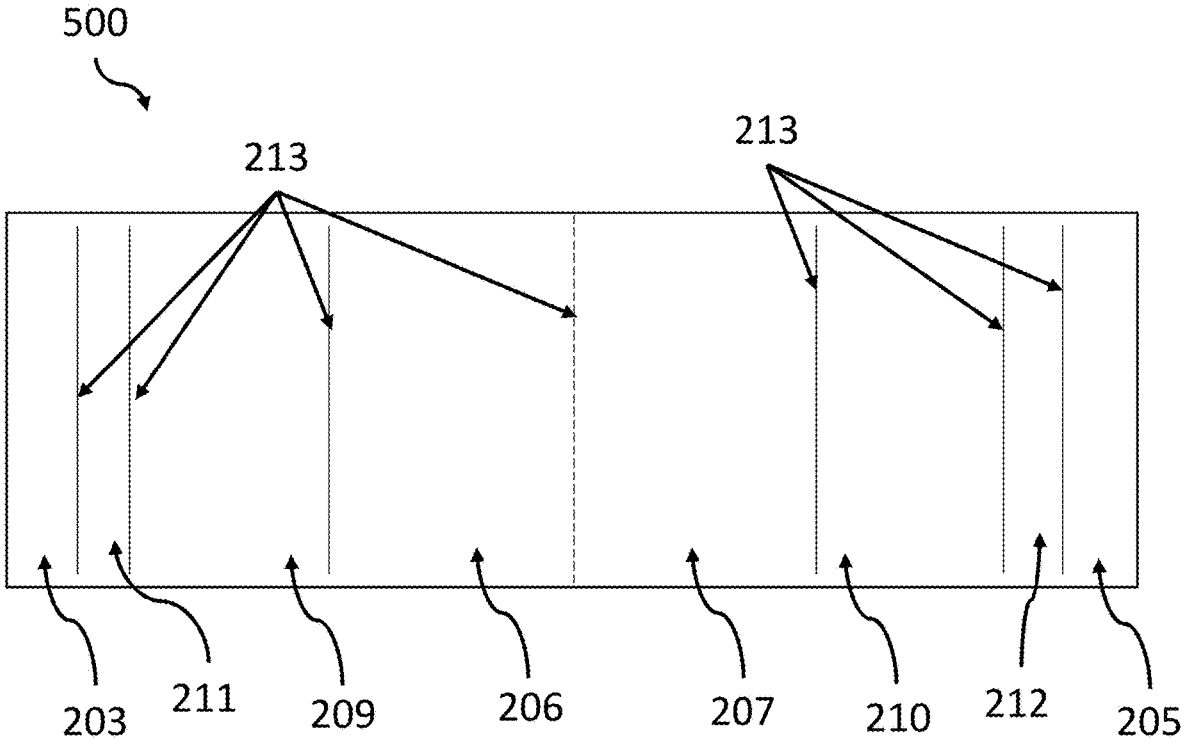
FIG. 5 illustrates an example planar support element blank.

FIG. 5 illustrates an example planar support element blank 500 for a support element according to this disclosure, in this case corresponding to support element 300. The blank 500 comprising a first flap 203, a first primary panel 206, a second primary panel 207, and a second flap 205 following each other in this order, each flap or panel being separated from the next by at least a fold line, the fold lines 213 being along a same linear direction. In this specific example, the blank also comprises a first secondary panel 209 and a second secondary panel 210 such that the first flap 203, the first secondary panel 209, the first primary panel 206, the second primary panel 207, the second secondary panel 210 and the second flap 205 follow each other in this order. In this example, the blank also comprises a first tertiary panel 211 and a second tertiary panel 212, such that the first flap 203, the first tertiary panel 211, the first secondary panel 209, the first primary panel 206, the second primary panel 207, the second secondary panel 210, the second tertiary panel 212 and the second flap 205 follow each other in this order. While the blank represented in FIG. 5 corresponds to the support element 200 for illustrative purposes, other blanks may correspond to other examples, comprising panels and fold lines corresponding to the respective support elements.

Figure 6:
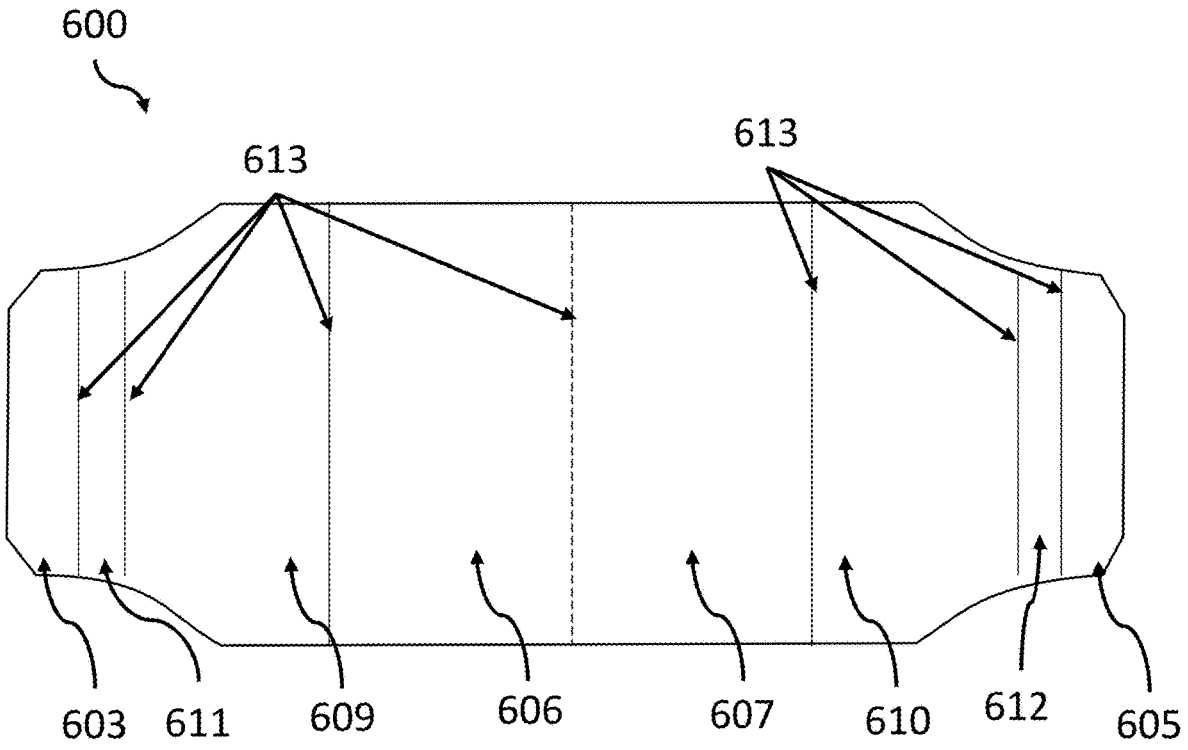
FIG. 6 illustrates another example planar support element blank.

FIG. 6 illustrates an example planar support element blank 600 for a support element according to this disclosure, in this case similar to support element 300. The blank 600 comprising a first flap 603, a first primary panel 606, a second primary panel 607, and a second flap 605 following each other in this order, each flap or panel being separated from the next by at least a fold line, the fold lines 613 being along a same linear direction. In this specific example, the blank also comprises a first secondary panel 609 and a second secondary panel 610 such that the first flap 603, the first secondary panel 609, the first primary panel 606, the second primary panel 607, the second secondary panel 610 and the second flap 605 follow each other in this order. In this example, the blank also comprises a first tertiary panel 611 and a second tertiary panel 612, such that the first flap 603, the first tertiary panel 611, the first secondary panel 609, the first primary panel 606, the second primary panel 607, the second secondary panel 610, the second tertiary panel 612 and the second flap 605 follow each other in this order. In this example, the first primary panel 606 and the second primary panel 607 have a first maximal width along a direction parallel to the linear ridge and the first flap 603 has a second maximal width along the direction parallel to the linear ridge, whereby the second maximal width is of less than 90% of the first maximal width. This configuration permits saving material while maintaining the function of the support element provided by the cardboard structure. In this example, the first and second flaps have chamfered edges which also participate in saving material.

In some examples, one or more panels such as the primary, secondary, or tertiary first or second panels have a width along a direction parallel to the linear ridge which varies, for example in order to accommodate for different shapes of lids, or for saving an amount of materials used, while maintaining the support function of the cardboard support element.

Figure 7:
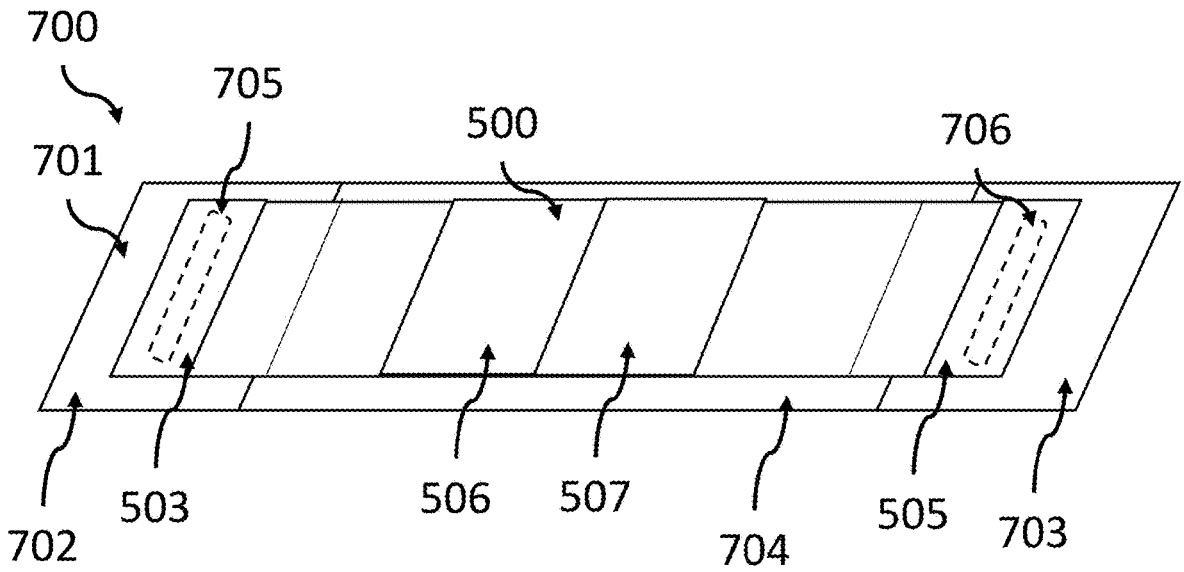
FIG. 7 illustrates an example planar blank assembly.

FIG. 7 illustrates an example planar blank assembly 700 comprising the support element blank according to this disclosure, in this case support element blank 500 illustrated in FIG. 5, and a lid blank 701, the lid blank comprising a first flank flap 702, a second flank flap 703 and a top panel 704 between the first flank flap 702 and the second flank flap 703, whereby the first flap 503 is affixed to first flank flap 702, whereby the first primary panel 506 and the second primary panel 507 rest freely on the top panel 704 and whereby the second flap 505 is affixed to the second flank flap 703. In other examples, the second flap 505 is affixed to the top panel 704. The support element blank may comprise other panels, as for example this support element blank 500 described in FIG. 5. The lid blank also may comprise other panels or flaps beyond the ones illustrated here.

Figure 8:
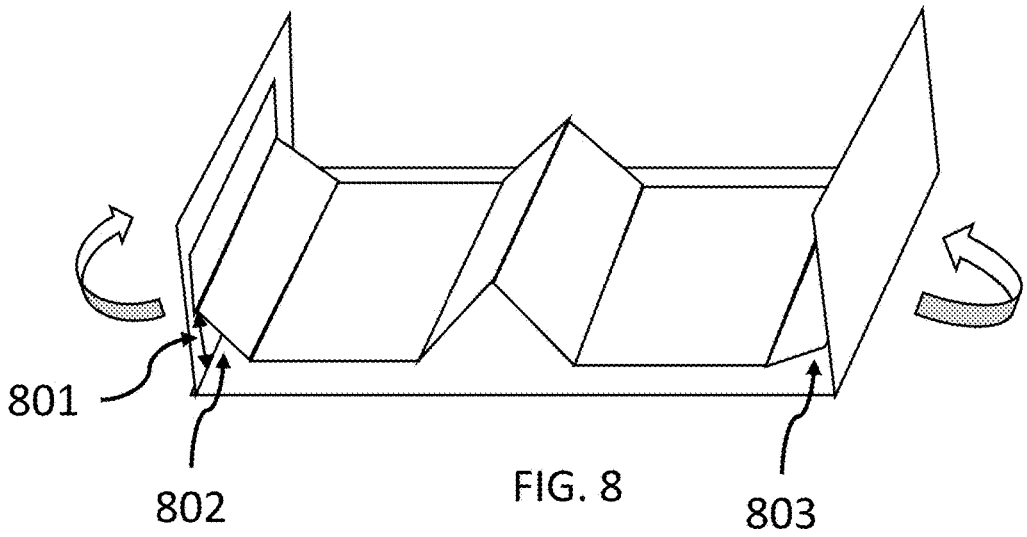
FIG. 8 illustrates an example method to erect a lid.

FIG. 8 illustrates an example method to erect a cardboard structure and a lid according to this disclosure from a planar blank assembly according to this disclosure, in this case planar blank assembly 700, the method comprising folding the first flank flap 702 to form a flank of the lid, the folding of the first flank flap 702 producing the erecting of the cardboard structure away from the top panel in a direction parallel to a direction of the folded flank to form the support element according to this disclosure. In this example, the second flank flap 703 is also folded to participate in erecting the lid according to this disclosure. In this example, the first flap 503 is affixed to the first flank flap 702 by glue 705. In this example, the second flap 505 is affixed to the second flank flap 703 by glue 706. In another example, the second flap may be glued to the top panel of the lid, in which case the cardboard structure may be erected solely by folding of the first flap.

The fact that the primary panels of the support element blank rest freely on the top panel of the lid blank, and the fact that the first and second flaps are affixed, wherein at least one of the first and second flaps are affixed to a flank flap of the lid, lead to erecting the cardboard structure as per this disclosure. This configuration permits providing a flat planar blank assembly as per this disclosure onto a manufacturing line, the flat planar assembly leading to erecting a lid using a reduced number of actions through the folding of the flanks of the lid. The folding of the flanks of the lid indeed lead to erecting both the lid flanks and the cardboard structure of the support element at the same time due to the affixing of the first and second flaps, wherein at least one of the first and second flaps are affixed to a flank flap of the lid, and due to the first and second primary panels resting freely onto the top panel and thereby moved away from the top panel by the folding action. While this is illustrated using a specific blank structure, a same effect may be obtained using other blank structures according to this disclosure. In order to permit the erecting, panels such as, for example, secondary or tertiary panels, situated between the first and second flaps should also rest freely on the top panel in order to slide into place naturally. The support element structure fold lines may be configured to form the support element as desired, for example by folding in one sense or in another sense. In some examples, when a first and secondary panel are provided, the first secondary panel and the second secondary panel each comprise at least one reinforcing element in order to maintain a planar configuration of each of the first secondary panel and the second secondary panel and to contribute to erecting the cardboard structure. Other examples comprise secondary panels without such reinforcing elements. Other panels or flaps may comprise reinforcing elements.

As illustrated in FIG. 8, the tertiary panels may push the secondary panels resting flush against the top panel, leading to the raising of the primary panels. In this configuration, the first and second flaps are separated from the tertiary panels by fold lines which are at a distance 801 from the base plane, such distance forming a triangular space 802, 803 formed by each tertiary panel, a portion of the respective flank flap of the lid and by a portion of the top panel.

Figure 9A:
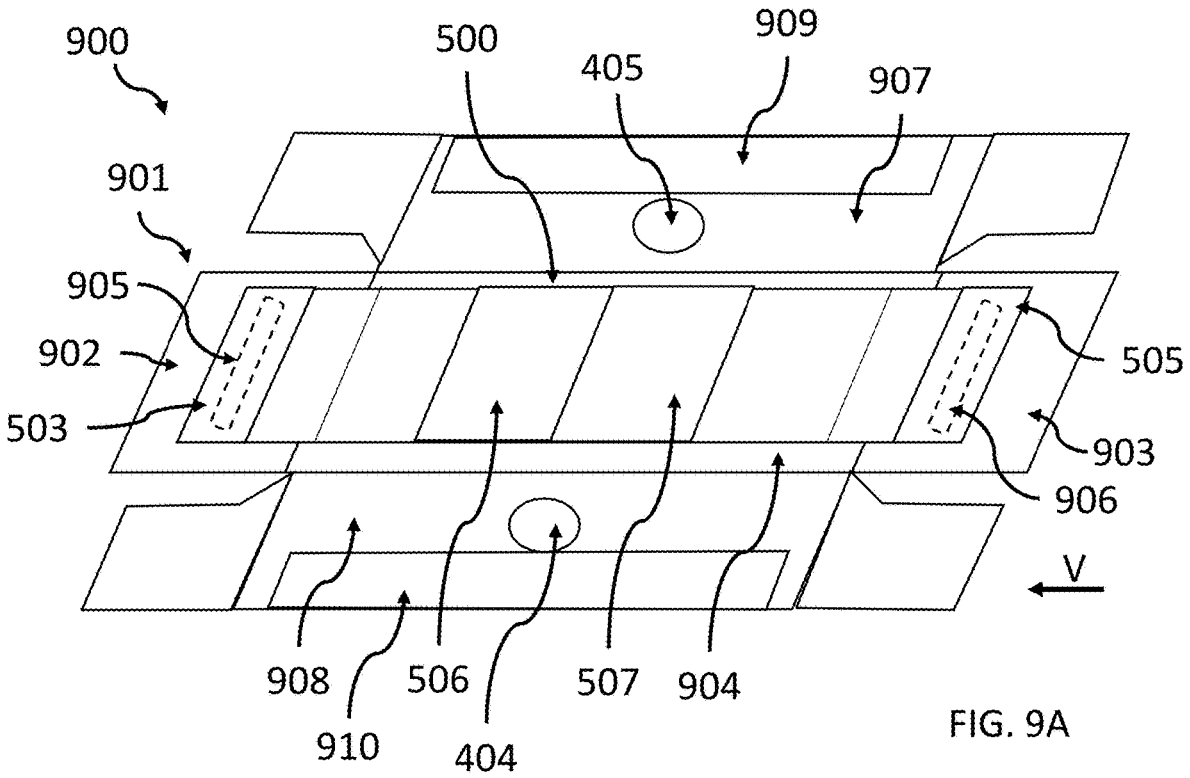
FIG. 9A illustrates another example planar blank assembly.

FIG. 9A illustrates a planar blank assembly 900 according to this disclosure. It is important to note that a planar blank assembly according to this disclosure greatly eases transportation in a stack formed by a plurality of such planar blank assemblies piled onto each other, whereby the blank of the lid is flush with the blank of the cardboard support element for each planar blank assemblies of the stack, whereby no elements "stick out" from the planar blank assembly, enabling shipment in a stable, efficient and cost effective manner, lowering a risk of damaging the planar assemblies. The planar blank assembly 900 comprises the support element blank 500 illustrated in FIG. 5, and a lid blank 901, the lid blank 901 comprising a first flank flap 902, a second flank flap 903 and a top panel 904 between the first flank flap 902 and the second flank flap 903, whereby the first flap 503 is affixed by glue 905 to first flank flap 902, whereby the first primary panel 506 and the second primary panel 507 rest freely on the top panel 904 and whereby the second flap 505 is affixed by glue 906 to the second flank flap 903. Lid blank 901 further comprises panels and flaps permitting forming four lid flanks, whereby the first flank flap 902 and the second flank flap 903 form two opposite short lid flanks, and panels 907 and 908 form two opposite long lid flanks. In this example, each long lid flank corresponding to panels 907 and 908 comprises a reinforced flank section 909 and 910. In some examples, such reinforced flank section comprises a main layer and an additional layer for reinforcement. In some examples, such reinforced flank section comprises a back folded additional layer. In some examples, such additional layer is glued to a main layer of the flanks. In some examples, either one of or both the box and the lid comprise a reinforcement area. Such reinforcement area may for example comprise a bended or folded back area. Such reinforcement area may for example comprise an additional glued material or layer. Such reinforcement area may comprise an insert or a sleeve. In some examples the reinforcement area covers specific areas of the box or lid. In some examples, the reinforcement area comprises the box base. In some examples, the reinforcement area comprises the sidewalls. In some examples, the reinforcement area comprises the flanks of the lid. In some examples, all areas of the box are reinforced. In some examples, all areas of the lid are reinforced. In some examples, the reinforced flank section comprises the locking tab. In some examples the reinforced flank section comprises a main flank section and a folded back flank section lying flush against the main flank section, the main flank section being hingedly connected to the folded back flank section at an end of the reinforced flank section distal from the top of the lid. Such flank reinforcement may contribute to reinforcing the structure of the closed container. The use of flank reinforcement, in particular of flank reinforcement which are folded back in a planar blank assembly according to this disclosure, permit having a same or similar thickness of the planar blank assembly at edges of the planar blank assembly (by way of the double thickness formed by the flank reinforcements) and towards the centre of the planar blank assembly (by way of the support element blank), such same or similar thickness of the planar blank assembly permitting obtaining a stable stack of such planar blank assembly for transportation to a manufacturing facility.

Figure 9B:
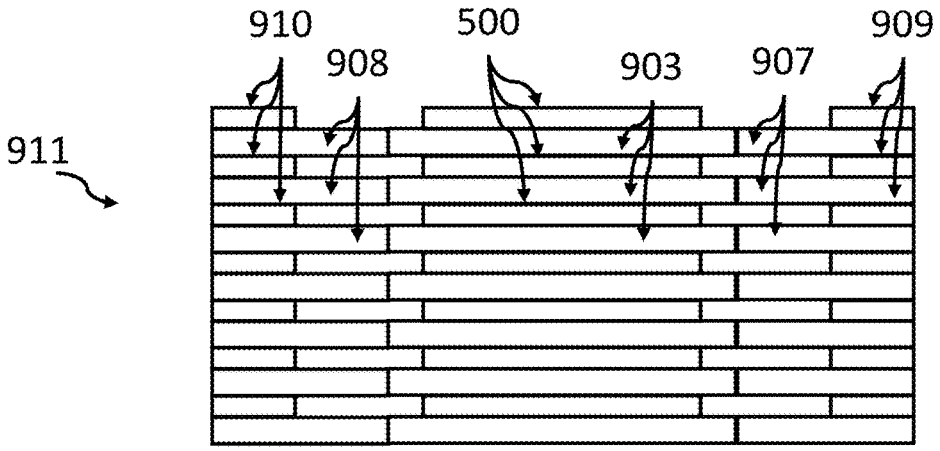
FIG. 9B illustrates another example planar blank assembly.

FIG. 9B illustrates an example stack 911 of a plurality of planar blank assemblies according to this disclosure, whereby each lid blank comprises a folded back flank section. In the illustrated example, each planar blank assembly of the stack 911 is seen along a direction illustrated by direction V of FIG. 9A. Stack 911 comprises 7 planar blank assemblies according to this disclosure. A stack may comprise more than 10 planar blank assemblies. A stack may comprise more than 20 planar blank assemblies. A stack may comprise more than 50 planar blank assemblies. A stack may comprise more than 70 planar blank assemblies. A stack may comprise more than 100 planar blank assemblies. A stack may comprise more than 150 planar blank assemblies. In this example, each planar blank assembly comprises a folded back flank section 910 and a folded back flank section 909 for flank reinforcement and a planar support element blank such as planar support element blank 500, as well as panels of the lid such as, for example, second flank flap 903, on which the planar support element blank and folded back flank sections lie flush. This forms a stable stack structure for transportation. In this example, a thickness of the planar support element blank is substantially equal to a thickness of folded back flank sections.

Figure 10:
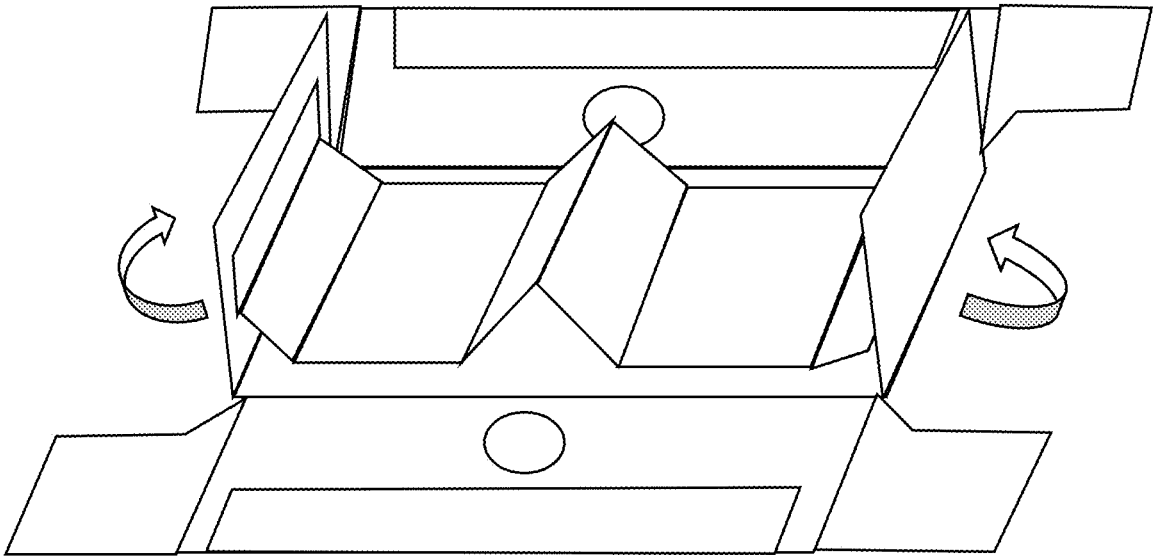
FIG. 10 illustrate another example method to erect a lid.

FIG. 10 illustrates a method to erect a lid from a planar blank assembly according to this disclosure, in this case from planar blank assembly 900 of FIG. 9A. As illustrated, the method comprises folding the first flank flap 902 to form a flank of the lid, the folding of the first flank flap 902 producing the erecting of the cardboard structure away from the top panel 904 in a direction parallel to a direction of the folded flank to form the support element according to this disclosure.

The lid obtained using planar blank assembly 900 corresponds to the lid 300 illustrated in FIG. 4 of consumer product 400. Consumer product 400 comprises a support element which enters the opening with a shape having a triangular cross section in a plane, reproducing a shape similar to an inverted gable roof.

Example support elements according to this disclosure may be described using vocabulary used in roof types. Example support elements according to this disclosure may comprise a cardboard structure forming an open gable shape, the open gable shape comprising a first and second primary panels and a ridge between the first and second primary panels. Example support elements according to this disclosure may comprise a cardboard structure forming a gambrel shape, the gambrel shape comprising a first and second primary panels, a first and second secondary panel, and a ridge between the first and second primary panels. Example support elements according to this disclosure may comprise a cardboard structure forming a saltbox shape, the saltbox shape comprising a first and second primary panels and a ridge between the first and second primary panels.

In some examples, the linear ridge is a line of symmetry of the cardboard structure or of the support element. This is the case for example of the support element formed by blanks 500 or 600. This is particularly suitable in cases of a lid comprising an actuator or actuation area located in a centre of a flank, whereby such lid may be placed in one sense or in another sense while remaining functional due to its symmetrical structure. In other words, and referring for example to FIG. 4, while actuation area 404 is aligned to correspond to actuator 403, the lid 300 is reversible and actuation 405 could be made to correspond to actuator 403 by placing the lid in a symmetrical manner.

The support element as per this disclosure may comprise a support element distal end located when the lid is in the closed position at a certain depth. In some examples, the depth is of at least 3 mm and of less than 50 mm from the top of the lid. In some examples, the depth is of at least 5 mm and of less than 50 mm from the top of the lid. In some examples, the depth is of at least 15 mm and of less than 40 mm from the top of the lid. In some examples, the depth is of at least 20 mm and of less than 35 mm from the top of the lid. The depth of the support element participates in reinforcing the structure of the consumer product. A combination of the depth and shape of the support element as well as amount of clearance distance may permit avoiding twisting the lid.

In some cases, a force is applied to the flanks in a direction normal to the base of the box, in a direction from the base of the box and towards the top of the lid. Such force may be applied for example when lifting the box from a floor to transport it. In such a situation the clearance distances which separates the sidewalls from the support element may be reduced to zero due to the weight of the content and of the box being applied to the locking tabs through the actuators. In such a situation, the support element permits avoiding accidental opening of the box due to sidewalls sinking in to a point that the actuators would be released from the locking tab, the box falling on the floor, the lid remaining in the hands of the person lifting the box by holding it by the lid. In this example and in some other examples, the detergent product weights more than 50% of the weight of the consumer product, whereby a gravity force produced on the base of the box by the detergent product in the absence of a reaction force on the base of the box produces a flexing of the specific portion of the sidewalls and a reduction of the clearance to zero, the actuator maintaining abutment against the locking tab when the clearance is reduced to zero and when no actuation pressure is applied. In some examples, the detergent product weights more than 70% of the weight of the consumer product in such a situation. In some examples, the detergent product weights more than 80% of the weight of the consumer product in such a situation.

In some cases, a force is applied to the actuators in a direction normal to the sidewalls, in a direction towards the inside of the box, for example by gripping the lid with one hand, a thumb on one side and the other fingers on the other. Such force may be applied for example when lifting the box from a floor to transport it. In such a situation the clearance distances may be reduced to zero due to the force sandwiching the sidewalls between the support element and the actuators. In such a situation, the static friction force between the side walls and the support element permits avoiding accidental opening of the box due to the lid getting disconnected from the sidewalls, the box falling on the floor, the lid remaining in the hand of the person lifting the bow by holding it by the lid.

In an example, the container is made from cardboard materials and is thereby made from materials which may be recycled.

In some examples, the consumer product comprises at least one water-soluble unit dose article and the container. The consumer product can be sold 'as is', in other words the consumer product is the item that the consumer picks up from the shelf. Alternatively, the consumer product could be housed as one unit of a multi-component product. For example, more than one consumer product could be housed within an outer package and the multiple packaged consumer products sold together in a single purchase. The consumer product may comprise aesthetic elements, for example shrink sleeves or labels attached to the container. Alternatively, the container may be coloured or printed with aesthetic elements or informative print such as usage instructions.

In some examples a water-soluble unit dose article comprises at least one water-soluble film orientated to create at least one-unit dose internal compartment, wherein the at least one-unit dose internal compartment comprises a detergent composition. The water-soluble film and the detergent composition are described in more detail below. In some examples the consumer product comprises at least one water-soluble unit dose article, in some cases at least two water-soluble unit dose articles, in some cases at least 10 water-soluble unit dose articles, in some cases at least 20 water-soluble unit dose articles, in some cases at least 30 water-soluble unit dose articles, in some cases at least 40 water-soluble unit dose articles, in some cases at least 45 water-soluble unit dose articles. A water-soluble unit dose article is in some examples in the form of a pouch. A water-soluble unit dose article comprises in some examples a unitary dose of a composition as a volume sufficient to provide a benefit in an end application. The water-soluble unit dose article comprises in some examples one water-soluble film shaped such that the unit-dose article comprises at least one internal compartment surrounded by the water-soluble film. The at least one compartment comprises a cleaning composition. The water-soluble film is sealed such that the cleaning composition does not leak out of the compartment during storage. However, upon addition of the water-soluble unit dose article to water, the water-soluble film dissolves and releases the contents of the internal compartment into the wash liquor. The unit dose article may comprise more than one compartment, at least two compartments, or at least three compartments, or at least four compartments, or even at least five compartments. The compartments may be arranged in superposed orientation, i.e. one positioned on top of the other. Alternatively, the compartments may be positioned in a side-by-side orientation, i.e. one orientated next to the other. The compartments may be orientated in a 'tyre and rim' arrangement, i.e. a first compartment is positioned next to a second compartment, but the first compartment at least partially surrounds the second compartment, but does not completely enclose the second compartment. Alternatively, one compartment may be completely enclosed within another compartment. In some examples the unit dose article comprises at least two compartments, one of the compartments being smaller than the other compartment. In some examples the unit dose article comprises at least three compartments, two of the compartments may be smaller than the third compartment, and in some examples the smaller compartments being superposed on the larger compartment. The superposed compartments are in some examples orientated side-by-side. In some examples each individual unit dose article may have a weight of between 10 g and 40 g, or even between 15 g and 35 g. The water soluble film may be soluble or dispersible in water. Prior to be being formed into a unit dose article, the water-soluble film has in some examples a thickness of from 20 to 150 micron, in other examples 35 to 125 micron, in further examples 50 to 110 micron, in yet further examples about 76 micron. Example water soluble film materials comprise polymeric materials. The film material can, for example, be obtained by casting, blow-moulding, extrusion or blown extrusion of the polymeric material. In some examples, the water-soluble film comprises polyvinyl alcohol polymer or copolymer, for example a blend of polyvinylalcohol polymers and/or polyvinylalcohol copolymers, for example selected from sulphonated and carboxylated anionic polyvinylalcohol copolymers especially carboxylated anionic polyvinylalcohol copolymers, for example a blend of a polyvinylalcohol homopolymer and a carboxylated anionic polyvinylalcohol copolymer. In some examples water soluble films are those supplied by Monosol under the trade references M8630, M8900, M8779, M8310. In some examples the film may be opaque, transparent or translucent. The film may comprise a printed area. The area of print may be achieved using techniques such as flexographic printing or inkjet printing. The film may comprise an aversive agent, for example a bittering agent. Suitable bittering agents include, but are not limited to, naringin, sucrose octaacetate, quinine hydrochloride, denatonium benzoate, or mixtures thereof. Example levels of aversive agent include, but are not limited to, 1 to 5000 ppm, 100 to 2500 ppm, or 250 to 2000 ppm. The water-soluble film or water-soluble unit dose article or both may be coated with a lubricating agent. In some examples, the lubricating agent is selected from talc, zinc oxide, silicas, siloxanes, zeolites, silicic acid, alumina, sodium sulphate, potassium sulphate, calcium carbonate, magnesium carbonate, sodium citrate, sodium tripolyphosphate, potassium citrate, potassium tripolyphosphate, calcium stearate, zinc stearate, magnesium stearate, starch, modified starches, clay, kaolin, gypsum, cyclodextrins or mixtures thereof.

In some examples the container comprises a first part, wherein the first part comprises a first compartment in which the at least one water-soluble unit dose article is contained. In some examples the first compartment comprises at least two water-soluble unit dose articles. The first compartment may comprise between 1 and 80 water-soluble unit dose articles, between 1 and 60 water-soluble unit dose articles, between 1 and 40 water-soluble unit dose articles, or between 1 and 20 water-soluble unit dose articles. The volume of the first compartment may be between 500 ml and 5000 ml, in some examples between 800 ml and 4000 ml.

In some examples the detergent product comprises a detergent composition. The detergent composition may be a laundry detergent composition, an automatic dishwashing composition, a hard surface cleaning composition, or a combination thereof. The detergent composition may comprise a solid, a liquid or a mixture thereof. The term liquid includes a gel, a solution, a dispersion, a paste, or a mixture thereof. The solid may be a powder. By powder we herein mean that the detergent composition may comprise solid particulates or may be a single homogenous solid. In some examples, the powder detergent composition comprises particles. This means that the powder detergent composition comprises individual solid particles as opposed to the solid being a single homogenous solid. The particles may be free-flowing or may be compacted. A laundry detergent composition can be used in a fabric hand wash operation or may be used in an automatic machine fabric wash operation, for example in an automatic machine fabric wash operation. Example laundry detergent compositions comprise a non-soap surfactant, wherein the non-soap surfactant comprises an anionic non-soap surfactant and a non-ionic surfactant. In some examples, the laundry detergent composition comprises between 10% and 60%, or between 20% and 55% by weight of the laundry detergent composition of the non-soap surfactant. Example weight ratio of non-soap anionic surfactant to nonionic surfactant are from 1:1 to 20:1, from 1.5:1 to 17.5:1, from 2:1 to 15:1, or from 2.5:1 to 13:1. Example non-soap anionic surfactants comprises linear alkylbenzene sulphonate, alkyl sulphate or a mixture thereof. Example weight ratio of linear alkylbenzene sulphonate to alkyl sulphate are from 1:2 to 9:1, from 1:1 to 7:1, from 1:1 to 5:1, or from 1:1 to 4:1. Example linear alkylbenzene sulphonates are $C_{10}$-$C_{16}$ alkyl benzene sulfonic acids, or $C_{11}$-$C_{14}$ alkyl benzene sulfonic acids. By 'linear', we herein mean the alkyl group is linear. Example alkyl sulphate anionic surfactant may comprise alkoxylated alkyl sulphate or non-alkoxylated alkyl sulphate or a mixture thereof. Example alkoxylated alkyl sulphate anionic surfactant comprise an ethoxylated alkyl sulphate anionic surfactant. Example alkyl sulphate anionic surfactant may comprise an ethoxylated alkyl sulphate anionic surfactant with a mol average degree of ethoxylation from 1 to 5, from 1 to 3, or from 2 to 3. Example alkyl sulphate anionic surfactant may comprise a non-ethoxylated alkyl sulphate and an ethoxylated alkyl sulphate wherein the mol average degree of ethoxylation of the alkyl sulphate anionic surfactant is from 1 to 5, from 1 to 3, or from 2 to 3. Example alkyl fraction of the alkyl sulphate anionic surfactant are derived from fatty alcohols, oxo-synthesized alcohols, Guerbet alcohols, or mixtures thereof. In some examples, the laundry detergent composition comprises between 10% and 50%, between 15% and 45%, between 20% and 40%, or between 30% and 40% by weight of the laundry detergent composition of the non-soap anionic surfactant. In some examples, the non-ionic surfactant is selected from alcohol alkoxylate, an oxo-synthesised alcohol alkoxylate, Guerbet alcohol alkoxylates, alkyl phenol alcohol alkoxylates, or a mixture thereof. In some examples, the laundry detergent composition comprises between 0.01% and 10%, between 0.01% and 8%, between 0.1% and 6%, or between 0.15% and 5% by weight of the liquid laundry detergent composition of a non-ionic surfactant. In some examples, the laundry detergent composition comprises between 1.5% and 20%, between 2% and 15%, between 3% and 10%, or between 4% and 8% by weight of the laundry detergent composition of soap, in some examples a fatty acid salt, in some examples an amine neutralized fatty acid salt, wherein in some examples the amine is an alkanolamine for example selected from monoethanolamine, diethanolamine, triethanolamine or a mixture thereof, in some examples monoethanolamine. In some examples, the laundry detergent composition is a liquid laundry detergent composition. In some examples the liquid laundry detergent composition comprises less than 15%, or less than 12% by weight of the liquid laundry detergent composition of water. In some examples, the laundry detergent composition is a liquid laundry detergent composition comprising a non-aqueous solvent selected from 1,2-propanediol, dipropylene glycol, tripropyleneglycol, glycerol, sorbitol, polyethylene glycol or a mixture thereof. In some examples, the liquid laundry detergent composition comprises between 10% and 40%, or between 15% and 30% by weight of the liquid laundry detergent composition of the non-aqueous solvent. In some examples, the laundry detergent composition comprises a perfume. In some examples, the laundry detergent composition comprises an adjunct ingredient selected from the group comprising builders including enzymes, citrate, bleach, bleach catalyst, dye, hueing dye, brightener, cleaning polymers including alkoxylated polyamines and polyethyleneimines, soil release polymer, surfactant, solvent, dye transfer inhibitors, chelant, encapsulated perfume, polycarboxylates, structurant, pH trimming agents, and mixtures thereof. In some examples, the laundry detergent composition has a pH between 6 and 10, between 6.5 and 8.9, or between 7 and 8, wherein the pH of the laundry detergent composition is measured as a 10% product concentration in demineralized water at 20° C. When liquid, the laundry detergent composition may be Newtonian or non-Newtonian. In some examples, the liquid laundry detergent composition is non-Newtonian. Without wishing to be bound by theory, a non-Newtonian liquid has properties that differ from those of a Newtonian liquid, more specifically, the viscosity of non-Newtonian liquids is dependent on shear rate, while a Newtonian liquid has a constant viscosity independent of the applied shear rate. The decreased viscosity upon shear application for non-Newtonian liquids is thought to further facilitate liquid detergent dissolution. The liquid laundry detergent composition described herein can have any suitable viscosity depending on factors such as formulated ingredients and purpose of the composition.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A consumer product comprising a detergent product contained in a container, the container comprising a box and a lid, wherein the lid comprises a top panel, opposing flanks extending from the top panel, and a support element, wherein the support element comprises a cardboard structure extending away from a base plane of the lid, a first flap connected to the cardboard structure and extended in a direction normal to the base plane and connected to one of the flanks, a second flap connected to the cardboard structure and extended in a direction normal to the base plane and connected to another of the flanks, wherein the cardboard structure further comprises a first primary panel and a second primary panel connected by a linear ridge, wherein said linear ridge is parallel to said top panel, wherein the box comprises a lock to maintain the lid in a closed position, the lock comprising an actuator aligned with the ridge when the lid is in a closed position, wherein the cardboard structure fits within the box when the lid is in the closed position.

2. The consumer product according to claim 1, wherein the support element is a plain board support element or a corrugated fiber board support element, whereby a folding line between the first flap and the cardboard structure is substantially perpendicular to a fiber direction of the plain board when the support element is a plain board support element, or substantially parallel to a flute direction of the corrugated fiber board when the support element is a corrugated fiber board support element.

3. The consumer product according to claim 1, wherein the support element further comprises a first secondary panel and a second secondary panel, the first secondary panel connecting the first flap and the first primary panel, the second secondary panel connecting the second flap and the second primary panel, whereby fold lines separate the first flap from the first secondary panel, the first secondary panel from the first primary panel, the first primary panel from the second primary panel, the second primary panel from the second secondary panel and the second secondary panel from the second flap, the fold lines being parallel to the linear ridge.

4. The consumer product according to claim 3, wherein the support element further comprises a first tertiary panel and a second tertiary panel, the first tertiary panel connecting the first flap and the first secondary panel, the second tertiary panel connecting the second flap and the second secondary panel, whereby fold lines separate the first flap from the first tertiary panel, the first tertiary panel from the first secondary panel, the second secondary panel from the second tertiary panel and the second tertiary panel from the second flap, the fold lines being parallel to the linear ridge.

5. The consumer product according to claim 3, wherein said first secondary panel and said second secondary panel rest freely on said top panel.

6. The consumer product according to claim 5, wherein said first tertiary panel and said second tertiary panel rest freely on said top panel.

* * * * *